US009897933B2

(12) United States Patent
Yoshida et al.

(10) Patent No.: US 9,897,933 B2
(45) Date of Patent: Feb. 20, 2018

(54) TONER

(71) Applicant: CANON KABUSHIKI KAISHA, Tokyo (JP)

(72) Inventors: Sara Yoshida, Mishima (JP); Katsuyuki Nonaka, Mishima (JP); Koji Abe, Numazu (JP); Toshihiko Katakura, Susono (JP); Akane Masumoto, Yokohama (JP); Maho Tanaka, Tokyo (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/415,397

(22) Filed: Jan. 25, 2017

(65) Prior Publication Data

US 2017/0219944 A1 Aug. 3, 2017

(30) Foreign Application Priority Data

Jan. 28, 2016 (JP) ..... 2016-014101

(51) Int. Cl.
*G03G 9/087* (2006.01)
*G03G 9/08* (2006.01)
*G03G 9/09* (2006.01)

(52) U.S. Cl.
CPC ..... *G03G 9/08702* (2013.01); *G03G 9/0819* (2013.01); *G03G 9/08711* (2013.01); *G03G 9/08755* (2013.01); *G03G 9/0918* (2013.01)

(58) Field of Classification Search
CPC ..... G03G 9/08702; G03G 9/0918; G03G 9/08755; G03G 9/0819; G03G 9/08711
See application file for complete search history.

(56) References Cited

U.S. PATENT DOCUMENTS

| | | | |
|---|---|---|---|
| 4,952,476 | A | 8/1990 | Sakashita et al. |
| 4,985,327 | A | 1/1991 | Sakashita et al. |
| 5,014,089 | A | 5/1991 | Sakashita et al. |
| 5,202,213 | A | 4/1993 | Nakahara et al. |
| 5,532,101 | A | 7/1996 | Nozawa et al. |
| 5,534,982 | A | 7/1996 | Sakaizawa et al. |
| 5,731,122 | A | 3/1998 | Yoshida et al. |
| 5,774,771 | A | 6/1998 | Kukimoto et al. |
| 5,915,150 | A | 6/1999 | Kukimoto et al. |
| 5,948,584 | A | 9/1999 | Hashimoto et al. |
| 5,998,080 | A | 12/1999 | Ohno et al. |
| 6,214,509 | B1 | 4/2001 | Kasuya et al. |
| 6,300,024 | B1 | 10/2001 | Yusa et al. |
| 6,337,169 | B1 | 1/2002 | Hashimoto et al. |
| 6,458,502 | B1 | 10/2002 | Nakamura et al. |
| 6,500,593 | B2 | 12/2002 | Abe et al. |
| 6,569,589 | B2 | 5/2003 | Inaba et al. |
| 6,696,211 | B2 | 2/2004 | Yoshida et al. |
| 6,806,016 | B2 | 10/2004 | Ohno et al. |
| 7,014,969 | B2 | 3/2006 | Yachi et al. |
| 7,300,737 | B2 | 11/2007 | Ayaki et al. |
| 7,459,253 | B2 | 12/2008 | Abe et al. |
| 7,704,661 | B2 | 4/2010 | Ikeda et al. |
| 8,053,156 | B2 | 11/2011 | Abe et al. |
| 8,084,178 | B2 | 12/2011 | Tosaka et al. |
| 8,247,147 | B2 | 8/2012 | Abe et al. |
| 8,367,289 | B2 | 2/2013 | Isono et al. |
| 8,440,382 | B2 | 5/2013 | Isono et al. |
| 8,497,054 | B2 | 7/2013 | Sugiyama et al. |
| 8,574,801 | B2 | 11/2013 | Itabashi et al. |
| 8,609,312 | B2 | 12/2013 | Itabashi et al. |
| 8,652,737 | B2 | 2/2014 | Handa et al. |
| 8,778,581 | B2 | 7/2014 | Nonaka et al. |
| 9,029,056 | B2 | 7/2015 | Kenmoku et al. |
| 9,098,002 | B2 | 8/2015 | Kenmoku et al. |
| 9,098,003 | B2 | 8/2015 | Masumoto et al. |
| 9,423,708 | B2 | 8/2016 | Tominaga et al. |
| 2001/0018158 | A1 | 8/2001 | Yoshida et al. |
| 2013/0065174 | A1 | 3/2013 | Itabashi et al. |
| 2015/0099220 | A1 | 4/2015 | Abe et al. |
| 2015/0099222 | A1* | 4/2015 | Terui ..... G03G 9/08708 430/109.3 |
| 2015/0099224 | A1* | 4/2015 | Abe ..... G03G 9/09328 430/110.2 |
| 2015/0248071 | A1 | 9/2015 | Katsuta et al. |
| 2015/0248072 | A1 | 9/2015 | Katsuta et al. |
| 2015/0286157 | A1 | 10/2015 | Masumoto et al. |
| 2015/0331344 | A1 | 11/2015 | Tominaga et al. |
| 2016/0299446 | A1 | 10/2016 | Kuroki et al. |
| 2016/0299447 | A1 | 10/2016 | Masumoto et al. |

FOREIGN PATENT DOCUMENTS

| | | |
|---|---|---|
| JP | 2010181439 A | 8/2010 |
| JP | 2014142605 A | 8/2014 |

* cited by examiner

*Primary Examiner* — Thorl Chea
(74) *Attorney, Agent, or Firm* — Fitzpatrick, Cella, Harper & Scinto

(57) ABSTRACT

Provided is a toner that is excellent in development durability and has excellent solid followability even when the amount of the toner in a toner cartridge is small. The toner includes toner particles each having a surface layer containing an organosilicon polymer, in which: the organosilicon polymer includes a siloxane-based polymer having partial structures represented by the following formulae (1) and (2); and in a chart obtained by $^{29}$Si-NMR measurement of a tetrahydrofuran-insoluble matter of the toner particles, an area RT3 of a peak assigned to the partial structure represented by the following formula (1) and an area RfT3 of a peak assigned to the partial structure represented by the following formula (2) satisfy the following formula (3).

$$0.300>(RfT3/RT3)\geq 0.010 \quad (3)$$

$$R—SiO_{3/2} \quad (1)$$

$$Rf—SiO_{3/2} \quad (2)$$

4 Claims, 1 Drawing Sheet

TONER

BACKGROUND OF THE INVENTION

Field of the Invention

The present invention relates to a toner for developing an electrostatic image to be used in image-forming methods, such as electrophotography and electrostatic printing.

Description of the Related Art

A typical apparatus of an electrophotographic system that uses a toner is, for example, a laser printer or a copying machine. In recent years, the colorization of such apparatus has rapidly advanced, and hence a further improvement in image quality has been required. Accordingly, various investigations have been made with a view to achieving the control of chargeability and flowability for obtaining stably high image quality.

In Japanese Patent Application Laid-Open No. 2014-142605, there is a disclosure of a technology involving externally adding silica particles each having a specific carbon content and composite oxide particles to toner particles to suppress a reduction in chargeability of a toner.

In addition, in recent years, the following design has been made. The amount of a toner to be loaded into a cartridge is reduced to the extent possible so that the toner may be used up at the time point of the exchange of the cartridge. In such design, at the timing at which the exchange of the cartridge is drawing near, the frequency at which the following cycle is repeated increases. The particles of one and the same toner are subjected to development, return to the cartridge without being developed, and subjected to development again. Thus, the toner repeatedly receives a mechanical stress. Accordingly, the toner is required to have higher development durability. When a reduction in charge quantity or flowability of the toner occurs in a state in which the amount of the toner in the toner cartridge is small, it becomes difficult to obtain a satisfactory solid image.

In such approach as disclosed in Japanese Patent Application Laid-Open No. 2014-142605 involving causing the fine particles to adhere to the surfaces of the toner particles to improve various kinds of performance, the deviation, embedment, or the like of the fine particles occurs as the toner is repeatedly used for a long time period. Accordingly, when the toner undergoes such cycle as described above, it becomes difficult to maintain desired chargeability and flowability thereof at high levels.

In view of the foregoing, in Japanese Patent Application Laid-Open No. 2010-181439, there is a proposal of a technology for an improvement in development durability. In Japanese Patent Application Laid-Open No. 2010-181439, an attempt to improve the development durability is made by: causing a silicon compound containing an ethylenically unsaturated bond to react with a toner to cover the surfaces of the particles of the toner; and externally adding inorganic particles from above the covered surfaces to improve the charging stability of the toner. However, an influence of the embedment of the inorganic particles cannot be ignored, and hence the development durability is still susceptible to improvement.

SUMMARY OF THE INVENTION

An object of the present invention is to provide a toner that is excellent in development durability and can provide a satisfactory solid image even after having continuously received a mechanical stress.

The present invention relates to a toner, including toner particles each having a surface layer containing an organosilicon polymer, in which:

the organosilicon polymer includes a siloxane-based polymer having partial structures represented by the following formulae (1) and (2); and in a chart obtained by $^{29}$Si-NMR measurement of a tetrahydrofuran-insoluble matter of the toner particles, an area RT3 of a peak assigned to the partial structure represented by the following formula (1) and an area RfT3 of a peak assigned to the partial structure represented by the following formula (2) satisfy the following formula (3):

$$0.300>(RfT3/RT3)\geq 0.010 \quad (3)$$

$$R—SiO_{3/2} \quad (1)$$

in the formula (1), R represents an alkyl group having 1 or more and 6 or less carbon atoms, or a phenyl group;

$$Rf—SiO_{3/2} \quad (2)$$

in the formula (2), Rf represents a structure represented by any one of the following formulae (i) and (ii), * in each of the formulae (i) and (ii) represents a bonding portion with a silicon atom, and L in the formula (ii) represents a methylene group, an ethylene group, or a phenylene group.

$$*—CH{=}CH_2 \quad (i)$$

$$*\text{-}L\text{-}CH{=}CH_2 \quad (ii)$$

Further features of the present invention will become apparent from the following description of exemplary embodiments with reference to the attached drawings.

DESCRIPTION OF THE EMBODIMENTS

Figure 1A:
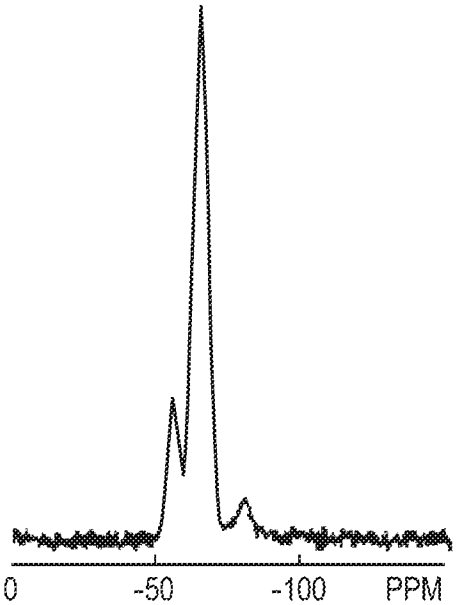
FIG. 1A is shows the peak of a measurement result in a chart which is measured by the $^{29}$Si-NMR of toner particles according to the present invention.

The present invention is described in detail below.

The present invention relates to a toner, including toner particles each having a surface layer containing an organosilicon polymer, in which:

the organosilicon polymer includes a siloxane-based polymer having partial structures represented by the following formulae (1) and (2); and in a chart obtained by $^{29}$Si-NMR measurement of a tetrahydrofuran-insoluble matter of the toner particles, an area RT3 of a peak assigned to the partial structure represented by the following formula (1) and an area RfT3 of a peak assigned to the partial structure represented by the following formula (2) satisfy the following formula (3):

$$0.300>(RfT3/RT3)\leq 0.010 \quad (3)$$

$$R—SiO_{3/2} \quad (1)$$

in the formula (1), R represents an alkyl group having 1 or more and 6 or less carbon atoms, or a phenyl group;

$$Rf—SiO_{3/2} \quad (2)$$

in the formula (2), Rf represents a structure represented by any one of the following formulae (i) and (ii), * in each of the formulae (i) and (ii) represents a bonding portion with a silicon atom, and L in the formula (ii) represents a methylene group, an ethylene group, or a phenylene group.

$$*\text{—CH=CH}_2 \quad \text{(i)}$$

$$*\text{-L-CH=CH}_2 \quad \text{(ii)}$$

The present invention relates to a toner, including toner particles each having a surface layer containing an organosilicon polymer, in which: the organosilicon polymer includes a siloxane-based polymer having partial structures represented by the following formulae (1) and (2). The deterioration of the toner is suppressed by the crosslinked structure of a siloxane-based polymer portion represented by —$SiO_{3/2}$ even in a state in which the amount of the toner in a toner cartridge is small like a state in which one and the same toner repeatedly passes a developing portion. As a result, the flowability and chargeability of the toner can be maintained even after the toner has been repeatedly used for a long time period.

In addition, the presence of the siloxane-based polymer portion containing —$SiO_{3/2}$ in the surface layer can improve the hydrophobicity of the surface of each of the toner particles, and hence improves the environmental stability including the chargeability and flowability of the toner. Further, the hydrophobicity is further improved by the presence of the group represented by "R" in the partial structure represented by the formula (1) and the presence of the structure represented by "Rf" in the partial structure represented by the formula (2). Accordingly, toner particles more excellent in environmental stability can be obtained.

The presence of the siloxane-based polymer portion may be confirmed by the $^{29}$Si-NMR measurement of the tetrahydrofuran-insoluble matter of the toner particles. In addition, the presence of the group represented by "R" and the structure represented by "Rf" may be confirmed by the $^{13}$C-NMR measurement of the tetrahydrofuran-insoluble matter of the toner particles.

In the present invention, it is essential that in the chart obtained by the $^{29}$Si-NMR measurement of the tetrahydrofuran-insoluble matter of the toner particles, a ratio between the area RT3 of the peak assigned to the partial structure represented by the formula (1) in the organosilicon polymer and the area RfT3 of the peak assigned to the partial structure represented by the formula (2) in the organosilicon polymer satisfy the following formula (3).

$$0.300>(RfT3/RT3)\leq 0.010 \quad (3)$$

In the partial structure represented by the formula (2), Rf represents a structure represented by any one of the formulae (i) and (ii), and represents a structure containing a vinyl group. * in each of the formulae (i) and (ii) represents a bonding portion with a silicon atom, and hence the structure containing a vinyl group is adjacent to the siloxane-based polymer portion —$SiO_{3/2}$. As a result of their extensive investigations, the inventors of the present invention have found that the structure containing a vinyl group is necessary for maintaining a satisfactory solid image in a state in which the amount of the toner in the toner cartridge is small. Although a mechanism for the foregoing is unclear, the inventors have considered that the presence of a carbon-carbon double bond connected to the siloxane-based polymer portion optimizes the charge densities of the toner particles to achieve an improvement in stability of each of the charge quantities of the toner particles and high flowability of the toner, and the achievement leads to stable formation of the solid image. The property by which the solid image can be stably formed is referred to as "solid followability."

In the present invention, not only the fact that the partial structure represented by the formula (2), the partial structure containing the structure represented by "Rf", is present but also the fact that the partial structure represented by the formula (2), the partial structure containing the structure represented by "Rf", is present at a specific presence ratio with respect to the partial structure represented by the formula (1), the partial structure containing the group represented by "R", is important. Specifically, the effects of the present invention are not exhibited until the formula (3) is satisfied. In the case where the amount of the structure represented by "Rf" is excessively large or excessively small as compared to that of the group represented by "R", it becomes difficult to form a satisfactory solid image when the amount of the toner in the toner cartridge reduces. In other words, the optimum value at which the effects of the present invention can be exhibited exists for the presence frequency of the structure containing a vinyl group.

The area RT3 and the area RfT3 more preferably satisfy the following formula (4).

$$0.200>(RfT3/RT3)\leq 0.050 \quad (4)$$

When the formula (4) is satisfied, an interaction between the toner particles and a charge density balance therebetween are optimized, and hence the flowability and chargeability of the toner are further improved. Thus, the solid followability can be satisfactorily improved.

In addition, in the organosilicon polymer, the number of carbon atoms in each of the group represented by "R" and the structure represented by "Rf" is preferably as small as possible. When the number of carbon atoms in each of the group represented by "R" and the structure represented by "Rf" is 3 or more, a reduction in property by which the organosilicon polymer is deposited on the surface of each of the toner particles occurs, and a reduction in property by which each of the toner particles is covered with the polymer occurs in association with the reduction. When the property by which each of the toner particles is covered with the polymer reduces, the surface layers of the toner particles each having the structure containing a vinyl group cannot be secured, and hence it becomes difficult to sufficiently exhibit the effects of the present invention. In addition, when the number of carbon atoms in each of the group represented by "R" and the structure represented by "Rf" is large, and the hydrophobicity of the surface of each of the toner particles is excessively large, a fluctuation in charge quantity of the toner tends to be large in various environments. Further, when the number of carbon atoms in each of the group represented by "R" and the structure represented by "Rf" is more than 6, the following tendency is observed: an aggregate having a size 1/10 or less of the weight-average particle diameter (μm) of the toner particles is liable to be formed on the surface of each of the toner particles. That is, a migratory silicon polymer generates and hence member contamination is liable to occur. From the viewpoints of the environmental stability of the toner and the prevention of the member contamination, the number of carbon atoms in each of the group represented by "R" and the structure represented by "Rf" is preferably as small as possible. Specifically, in the partial structure represented by the formula (1), R preferably represents a methyl group or an ethyl group, and more preferably represents a methyl group. In addition, in the partial structure represented by the formula (2), it is preferred that Rf represent a structure represented by the formula (i) or a structure represented by the formula (ii), and L represent a methylene group. The partial structure represented by the formula (1) is more preferred.

In the partial structure represented by the formula (2), when Rf represents a structure represented by the formula (ii), it is also necessary that L represent a hydrocarbon group. For example, when L contains an ester group, the bonding force of an ester bond is weak, and hence the development durability of the toner tends to be liable to reduce. Accordingly, it is difficult to obtain the effects of the present invention.

The fact that the partial structures represented by the formulae (1) and (2) each have —$SiO_{3/2}$ is also important in the present invention. In the case of a structure (—$SiO_2$/2) in which a silicon atom is bonded to two oxygen atoms, it becomes difficult to secure the development durability. This is because when the silicon atom is bonded to a larger number of oxygen atoms, the silicon atom builds an inorganic network structure to be close to a hard silica structure represented by $SiO_2$. If most of the siloxane-based polymer portions in the surface layers of the toner particles are each —$SiO_{2/2}$, the portions are of linear structures, and hence soft and resinous properties become dominant in the surfaces of the toner particles. That is, a reduction in development durability occurs, and hence it becomes difficult to improve the solid followability in a state in which the amount of the toner in the toner cartridge is small. Meanwhile, when the siloxane-based polymer portions are each —$SiO_{4/2}$, i.e., a hard silica structure represented by $SiO_2$, in the partial structure represented by the formula (1), R for securing the hydrophobicity is not present. Accordingly, the hydrophobicity of the organosilicon polymer weakens and hence the charging stability of the toner reduces. Accordingly, the effects of the present invention cannot be obtained.

The ratio between the areas of the peaks may be controlled mainly by the kind and amount ratio of a monomer of the organosilicon polymer. In addition to the foregoing, the ratio may also be controlled by a reaction temperature, a reaction time, a reaction solvent, and a pH at the time of the formation of the organosilicon polymer, and the kind and amount of an initiator.

A more preferred construction of the toner of the present invention is as follows: when, in the X-ray photoelectron spectroscopic analysis of the surface of each of the toner particles according to the present invention, the total of a carbon atom density dC, an oxygen atom density dO, and a silicon atom density dSi in the surface of the toner particle is defined as 100.0 atomic %, the silicon atom density dSi is 2.5 atomic % or more and less than 28.6 atomic %.

The X-ray photoelectron spectroscopic analysis is intended for the performance of the elemental analysis of the outermost surface having a thickness of several nanometers, and as the silicon atom density dSi becomes higher, a larger amount of the organosilicon polymer of the present invention is present in the surface of each of the toner particles. When the dSi is 2.5 atomic % or more, a sufficient amount of the organosilicon polymer is present in the surface of each of the toner particles, and hence the surface energy of the surface layer can be reduced. Thus, the flowability of the toner is improved, and hence a solid image can be more stably formed even when the amount of the toner in the toner cartridge is small. In addition, the environmental stability is also improved.

The silicon atom density dSi is more preferably 9.0 atomic % or more.

In addition, the dSi may be controlled by a method of producing the toner particles at the time of the formation of the organosilicon polymer, the reaction temperature, the reaction time, the reaction solvent, and the pH at the time of the formation of the organosilicon polymer, and the kind and amount of the monomer of the organosilicon polymer.

In addition, the toner particles according to the present invention each preferably contain 2.40 mass % or more and 9.80 mass % or less of the organosilicon polymer. When the content of the organosilicon polymer falls within the range, the development durability can be improved irrespective of an environment, and hence a satisfactory solid image can be formed even in a state in which the amount of the toner in the toner cartridge is small. Further, the member contamination can be suppressed. The content is more preferably 3.10 mass % or more and 6.90 mass % or less.

The toner particles according to the present invention each have a surface layer containing an organosilicon polymer, and may be produced by, for example, a production method including the following steps (i) to (iv). An organosilicon compound represented by the following formula (5) is referred to as "organosilicon compound A," and an organosilicon compound represented by the following formula (6) or (7) is referred to as "organosilicon compound B."

(i) A step A1 of causing the organosilicon compound A and a toner particle precursor to coexist in an aqueous medium.

(ii) A step B1 of hydrolyzing, after the step A1, at least part of the organosilicon compound A, followed by its condensation.

(iii) A step C1 of mixing, after the step B1, the aqueous medium that has undergone the step B1 and the organosilicon compound B.

(iv) A step D1 of hydrolyzing, after the step C1, at least part of the organosilicon compound B, followed by its condensation.

A production method in which the order in which the organosilicon compound A and the organosilicon compound B are added is inverted is also permitted. Specifically, the method includes such steps as described below.

(i) A step A2 of causing the organosilicon compound B and a toner particle precursor to coexist in an aqueous medium.

(ii) A step B2 of hydrolyzing, after the step A2, at least part of the organosilicon compound B, followed by its condensation.

(iii) A step C2 of mixing, after the step B2, the aqueous medium that has undergone the step B2 and the organosilicon compound A.

(iv) A step D2 of hydrolyzing, after the step C2, at least part of the organosilicon compound A, followed by its condensation.

(5)

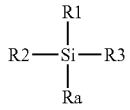

(6)

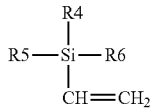

-continued (7)

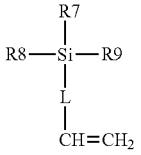

In the formulae (5) to (7), Ra represents an alkyl group having 1 or more and 6 or less carbon atoms, or a phenyl group, R1 to R9 each represent a halogen atom, a hydroxy group, or an alkoxy group, and L represents a methylene group, an ethylene group, or a phenylene group.

In the production method, through the use of the organosilicon compound A or B present in the aqueous medium in advance, the compound being at least partially condensed, as a nucleus, the growth reaction of the organosilicon compound B or A caused to be present in the aqueous medium later occurs. Thus, the organosilicon polymer of the present invention can be effectively stuck to the surface of each of the toner particles. As a result, the development durability can be improved.

The term "toner particle precursor" as used herein refers to raw materials for the toner particles brought into droplet states by their mixing and granulation, or to resin particles obtained by the polymerization or aggregation of part of the raw materials in the droplets.

A typical approach to causing the toner particle precursor and the organosilicon compound to coexist in the aqueous medium in the step A1 or A2 is, for example, any one of the following methods:

(1) an approach involving loading, into the aqueous medium, the raw materials serving as the toner particle precursor in a state of being mixed with the organosilicon compound, and granulating the mixture to provide the toner particle precursor;

(2) an approach involving loading the organosilicon compound into the aqueous medium in a state in which the toner particle precursor has been formed in the aqueous medium; and (3) an approach involving mixing the aqueous medium in which the toner particle precursor has been formed and another aqueous medium into which the organosilicon compound has been loaded.

In addition, an approach to mixing the aqueous medium and the organosilicon compound in the step C1 or C2 is, for example, any one of the following methods:

(1) an approach involving loading the organosilicon compound into the aqueous medium; and (2) an approach involving mixing the aqueous medium and another aqueous medium into which the organosilicon compound has been loaded.

In the production method for the toner particles according to the present invention, it is important that in each of the steps B1 and B2, part of the organosilicon compound to be caused to be present in the aqueous medium in advance be condensed. In order that the organosilicon compound may be condensed in the aqueous medium, in ordinary cases, an organosilicon compound having a hydrolyzable functional group is used, and dehydration condensation based on a silanol group to be formed after hydrolysis is utilized.

The hydrolysis of each of the organosilicon compounds A and B starts stochastically and kinetically from the moment the compound is loaded into the aqueous medium. In general, the hydrolysis is easily advanced under an acidic or alkaline condition. In addition, the hydrolysis is also advanced by increasing the temperature of the aqueous medium. Specifically, when the pH of the aqueous medium is 6 or less, or is 8 or more, or when the temperature of the aqueous medium is 70° C. or more, the hydrolysis of each of the organosilicon compounds A and B easily occurs. The occurrence of the hydrolysis produces a silanol group —SiOH. In general, a silanol group has high reactivity, and hence when silanol groups are brought into contact with each other, the groups easily cause dehydration condensation to form a siloxane bond Si—O—Si. Accordingly, the condensation of the organosilicon compound in each of the steps B1 and B2 can be qualitatively grasped by measuring the amount of production of a hydrolysate derived from the organosilicon compound. As a guideline on the hydrolysis in each of the steps B1 and B2 in the production method, when the amount of the hydrolysate to be produced in the case where all the hydrolyzable functional groups of the organosilicon compound are hydrolyzed is defined as 100 mol %, 1 mol % or more of the hydrolysate should be produced. Alternatively, the condensation of the organosilicon compound in each of the steps B1 and B2 can be grasped by measuring the molecular weight of a condensate derived from the organosilicon compound present in the aqueous medium. As a guideline on the condensation in each of the steps B1 and B2 in the production method, the molecular weight of the condensate should be the molecular weight of a dimer or more of the hydrolysate of the organosilicon compound.

Here, the mechanism via which the organosilicon polymer is effectively stuck to the surface of each of the toner particles according to the present invention by the production method is considered. Although the organosilicon compounds A and B are hydrophobic before hydrolysis, when the compounds are hydrolyzed to produce silanol groups, the hydrophilicity of each of the compounds strengthens in one stroke. Accordingly, the hydrolysates of the organosilicon compounds A and B are localized on the surface of the toner particle precursor in the aqueous medium, and dehydration condensation can be advanced on the surface of the toner particle precursor. That is, an inorganic network based on the siloxane-based polymer portion can be formed on the surface of the toner particle precursor.

Meanwhile, with regard to the organosilicon compound B, not only such formation of a siloxane bond as described above but also the formation of an organic network by the addition polymerization of a vinyl-based functional group represented by each of the formulae (6) and (7) may occur. The addition polymerization of such vinyl-based functional group may occur between the molecules of the organosilicon compound B, or may occur between the toner particle precursor and the organosilicon compound B depending on the composition of the toner particle precursor. A method to be used for accelerating the addition polymerization is, for example, to add an additional initiator or to mix an initiator and the organosilicon compound B in advance.

When at least part of the organosilicon compound A or B is condensed, a state in which a compound derived from the organosilicon compound A or B is localized on the surface of the toner particle precursor is established. The organosilicon compound B or A loaded into the aqueous medium thereafter is absorbed in the compound derived from the organosilicon compound A or B present on the surface of the toner particle precursor by the influences of a hydrophobic interaction between the compounds and a high affinity resulting from similarity between the structures of the compounds. At this time, at least part of the organosilicon compound A or B caused to be present in the aqueous medium in advance is condensed, and hence the organosilicon compound B or A loaded later hardly diffuses in the compound derived from the organosilicon compound A or B. Accordingly, the organosilicon compound B or A loaded later remains at a high density on the surface of the compound derived from the organosilicon compound A or B localized on the surface of the toner particle precursor in advance, and hence dehydration condensation between silanol groups is advanced by using the partially condensed compound as a nucleus.

When the organosilicon compound A and the organosilicon compound B are separately loaded into the aqueous medium and condensed as described above, the growth reaction of the organosilicon compound B or A loaded later occurs through the use of the organosilicon compound A or B that has been at least partially condensed as a nucleus. In other words, in the toner particles according to the present invention, the ratio at which the organosilicon polymer is stuck to the surface of each of the toner particles can be increased as compared to that in the case where the organosilicon compounds A and B are simultaneously caused to coexist in the aqueous medium. That is, the solid followability-maintaining effect of the organosilicon polymer satisfying the formula (3) can be satisfactorily exhibited. Further, when the organosilicon compound A and the organosilicon compound B are separately loaded and condensed, the organosilicon compound A and the organosilicon compound B are prevented from being randomly condensed, and hence a polymer portion derived from each of the compounds is easily formed. Thus, the frequency at which the vinyl groups of the molecules of the organosilicon compound B encounter increases, and hence the compound is localized on the surface of each of the toner particles. Although a mechanism for the foregoing is unclear, the inventors have considered that the n-electrons of the carbon-carbon double bond connected to the siloxane-based polymer portion interact with each other to improve the stability of the solid followability in a wide variety of environments. As a result of the foregoing, the maintenance of the solid followability in a state in which the amount of the toner in the toner cartridge is small serving as an effect of the present invention can be made more stable in various environments.

When the toner is produced by the above-mentioned method, the order in which the organosilicon compound A and the organosilicon compound B are loaded into the aqueous medium and condensed may be any one of the orders as described above. However, when the toner particle precursor has a vinyl-based functional group, from the viewpoint of low-temperature fixability, the method (steps A1 to D1) involving loading the organosilicon compound A into the aqueous medium and condensing the compound in advance, and loading and condensing the organosilicon compound B later is preferred. The inventors have considered that a compound derived from the organosilicon compound B is easily formed so as to cover a compound derived from the organosilicon compound A, though it is difficult to identify which one of the compounds covers the other through analysis. Thus, the degree of crosslinking between the organosilicon compound B and the toner particle precursor can be optimized, and hence an effect can be exhibited on the low-temperature fixability.

The organosilicon compound A may contain a compound represented by the following formula (8) and/or the following formula (9) in addition to the compound represented by the formula (5).

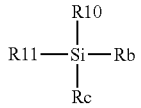

(8)

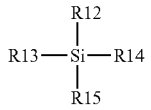

(9)

In the formulae (8) and (9), Rb and Rc each represent an alkyl group having 1 or more and 6 or less carbon atoms, or a phenyl group, and R10 to R15 each represent a halogen atom, a hydroxy group, or an alkoxy group.

R1 to R15 in the formulae (5) to (9) each independently represent a halogen atom, a hydroxy group, or an alkoxy group (the groups are hereinafter represented as "reactive groups"). Those reactive groups undergo hydrolysis, addition polymerization, and condensation polymerization to form a crosslinked structure based on a siloxane bond (Si—O—Si). The reactive groups are each preferably an alkoxy group having mild hydrolyzability at room temperature in terms of the controllability of a polymerization condition and the ease with which a siloxane structure is formed. Further, the reactive groups are each more preferably a methoxy group or an ethoxy group from the viewpoints of: the property by which the organosilicon polymer is deposited on the surface of each of the toner particles; and the property by which each of the toner particles is covered with the polymer. The hydrolysis, addition polymerization, and condensation polymerization of the reactive groups may each be controlled by a reaction temperature, a reaction time, a reaction solvent, and a pH.

The toner particle precursor is preferably:

(a) a precursor obtained by granulating a polymerizable monomer composition containing a colorant and a polymerizable monomer in an aqueous medium; or (b) a precursor obtained by polymerizing at least part of the polymerizable monomer after the granulation.

In addition, when the toner particle precursor containing the polymerizable monomer is used, it is important from the viewpoint of production stability that a polymerization conversion ratio in the step C1 or A2 be 90% or more.

Under the condition, excessive advance of polymerization between the polymerizable monomer in the toner particle precursor and the organosilicon compound B can be suppressed. Thus, a value for the RfT3 reduces and hence such a toner as to satisfy the formula (3) is stably obtained with ease.

Meanwhile, the polymerization conversion ratio of the polymerizable monomer in the toner particle precursor in the step C1 or A2 is preferably less than 99%. When the polymerization conversion ratio is less than 99%, the polymerization between the polymerizable monomer in the toner particle precursor and the organosilicon compound B moderately advances. Thus, an adhesive property between the inside and surface layer of each of the toner particles becomes stronger, and hence the amount of a migratory organosilicon polymer reduces. The reduction is advantageous for the prevention of the member contamination.

When the toner particles are produced in the aqueous medium, the organosilicon compounds are easily caused to be present on the surface of each of the toner particles by hydrophilicity exhibited by a hydrophilic group, such as a silanol group of each of the organosilicon compounds. Accordingly, a core-shell structure in which the organosilicon polymer forms a surface layer is easily controlled.

The toner particle precursor may be a precursor obtained by: dissolving or dispersing the colorant and a binder resin in an organic solvent; and granulating the resultant in the aqueous medium. Also in this case, the organosilicon compounds can be easily caused to be present on the surface of each of the toner particles. Thus, the organosilicon polymer can be efficiently formed on the surface of each of the toner particles.

A method of producing the organosilicon polymer is typically, for example, a production method called a sol-gel method. The sol-gel method is a method in which a metal alkoxide M(OR)n (M: a metal, O: oxygen, R: a hydrocarbon, n: the oxidation number of the metal) is used as a starting raw material, and the metal alkoxide is subjected to hydrolysis and condensation polymerization in a solvent to be caused to gel through a sol state. The method is used in the synthesis of glass, ceramics, organic-inorganic hybrids, or nanocomposites. According to the production method, functional materials of various shapes, such as a surface layer, a fiber, a bulk body, and a fine particle, can each be produced from a liquid phase at low temperature.

When the toner is produced by the above-mentioned production method, the surface layer of each of the toner particles is specifically produced by the hydrolysis polycondensation of an organosilicon compound typified by an alkoxysilane.

Further, in the sol-gel method, various fine structures and shapes can be produced because a solution is used as a starting raw material and the material is formed by causing the solution to gel. Particularly when the toner particles are produced in the aqueous medium, the organosilicon compounds are easily caused to be present on the surface of each of the toner particles by hydrophilicity exhibited by a hydrophilic group, such as a silanol group of each of the organosilicon compounds. However, in the case where the hydrophobicity of each of the organosilicon compounds is excessively large (e.g., in the case where the organosilicon compounds each have a functional group having high hydrophobicity), it becomes difficult to deposit the organosilicon compounds on the surface layer of each of the toner particles. As a result, it becomes difficult for each of the toner particles to form the surface layer containing the organosilicon polymer. Meanwhile, in the case where the hydrophobicity of each of the organosilicon compounds is excessively small, even when the surface layer of each of the toner particles contains the organosilicon polymer, the charging stability of the toner tends to reduce. The fine structures and the shapes may be adjusted by, for example, a reaction temperature, a reaction time, a reaction solvent, and a pH, and the kinds and addition amounts of the organosilicon compounds.

Examples of the compounds (the organosilicon compounds A and B) that each produce a structure represented by the formula (1) or (2) through condensation include: trifunctional vinylsilanes, such as vinyltrimethoxysilane, vinyltriethoxysilane, vinyldiethoxymethoxysilane, vinylethoxydimethoxysilane, vinyltrichlorosilane, vinylmethoxydichlorosilane, vinylethoxydichlorosilane, vinyldimethoxychlorosilane, vinylmethoxyethoxychlorosilane, vinyldiethoxychlorosilane, vinyltriacetoxysilane, vinyldiacetoxymethoxysilane, vinyldiacetoxyethoxysilane, vinylacetoxydimethoxysilane, vinylacetoxymethoxyethoxysilane, vinylacetoxydiethoxysilane, vinyltrihydroxysilane, vinylmethoxydihydroxysilane, vinylethoxydihydroxysilane, vinyldimethoxyhydroxysilane, vinylethoxymethoxyhydroxysilane, and vinyldiethoxyhydroxysilane; trifunctional allylsilanes, such as allyltrimethoxysilane, allyltriethoxysilane, allyldiethoxymethoxysilane, allylethoxydimethoxysilane, allyltrichlorosilane, allylmethoxydichlorosilane, allylethoxydichlorosilane, allyldimethoxychlorosilane, allylmethoxyethoxychlorosilane, allyldiethoxychlorosilane, allyltriacetoxysilane, allyldiacetoxymethoxysilane, allyldiacetoxyethoxysilane, allylacetoxydimethoxysilane, allylacetoxymethoxyethoxysilane, allylacetoxydiethoxysilane, allyltrihydroxysilane, allylmethoxydihydroxysilane, allylethoxydihydroxysilane, allyldimethoxyhydroxysilane, allylethoxymethoxyhydroxysilane, and allyldiethoxyhydroxysilane; trifunctional methylsilanes, such as p-styryltrimethoxysilane, methyltrimethoxysilane, methyltriethoxysilane, methyldiethoxymethoxysilane, methylethoxydimethoxysilane, methyltrichlorosilane, methylmethoxydichlorosilane, methylethoxydichlorosilane, methyldimethoxychlorosilane, methylmethoxyethoxychlorosilane, methyldiethoxychlorosilane, methyltriacetoxysilane, methyldiacetoxymethoxysilane, methyldiacetoxyethoxysilane, methylacetoxydimethoxysilane, methylacetoxymethoxyethoxysilane, methylacetoxydiethoxysilane, methyltrihydroxysilane, methylmethoxydihydroxysilane, methylethoxydihydroxysilane, methyldimethoxyhydroxysilane, methylethoxymethoxyhydroxysilane, and methyldiethoxyhydroxysilane; trifunctional ethylsilanes, such as ethyltrimethoxysilane, ethyltriethoxysilane, ethyltrichlorosilane, ethyltriacetoxysilane, and ethyltrihydroxysilane; trifunctional propylsilanes, such as propyltrimethoxysilane, propyltriethoxysilane, propyltrichlorosilane, propyltriacetoxysilane, and propyltrihydroxysilane; trifunctional butylsilanes, such as butyltrimethoxysilane, butyltriethoxysilane, butyltrichlorosilane, butyltriacetoxysilane, and butyltrihydroxysilane; trifunctional hexylsilanes, such as hexyltrimethoxysilane, hexyltriethoxysilane, hexyltrichlorosilane, hexyltriacetoxysilane, and hexyltrihydroxysilane; and trifunctional phenylsilanes, such as phenyltrimethoxysilane, phenyltriethoxysilane, phenyltrichlorosilane, phenyltriacetoxysilane, and phenyltrihydroxysilane. One kind of those compounds may be used alone, or two or more kinds thereof may be used in combination.

The ratio of units derived from the organosilicon compounds satisfying the formula (3) or (4) as a result of the hydrolysis polycondensation is preferably 50 mol % or more, more preferably 60 mol % or more in all units constituting the organosilicon polymer.

In addition, an organosilicon compound having four reactive groups in one molecule thereof (tetrafunctional silane), an organosilicon compound having three reactive groups in one molecule thereof (trifunctional silane), an organosilicon compound having two reactive groups in one molecule thereof (bifunctional silane), or an organosilicon compound having one reactive group (monofunctional silane) may be used in combination with the organosilicon compounds that each produce a partial structure represented by the formula (1) or (2) through the hydrolysis polycondensation. Examples of the organosilicon compounds that may be used in combination include: dimethyldiethoxysilane, tetraethoxysilane, hexamethyldisilazane, 3-glycidoxypropyltrimethoxysilane, 3-glycidoxypropylmethyldimethoxysilane, 3-glycidoxypropylmethyldiethoxysilane, 3-glycidoxypropyltriethoxysilane, 2-(3,4-epoxycyclohexyl)ethyltrimethoxysilane, 3-methacryloxypropylmethyldimethoxysilane, 3-methacryloxypropylmethyldiethoxysilane, 3-methacryloxypropyltriethoxysilane, 3-acryloxypropyltrimethoxysilane, 3-aminopropyltrimethoxysilane, 3-aminopropyltriethoxysilane, N-2-(aminoethyl)-3-aminopropyltrimethoxysilane, N-2-(aminoethyl)-3-aminopropyltriethoxysilane, N-2-(aminoethyl)-3-aminopropylmethyldimethoxysilane, N-phenyl-3-aminopropyltrimethoxysilane, 3-ureidopropyltriethoxysilane, 3-chloropropyltrimethoxysilane, 3-anilinopropyltrimethoxysilane, 3-mercaptopropylmethyldimethoxysilane, 3-mercaptopropyltrimethoxysilane, 3-mercaptopropyltriethoxysilane, bis(triethoxysilylpropyl) tetrasulfide, trimethylsilyl chloride, triethylsilyl chloride, triisopropylsilyl chloride, t-butyldimethylsilyl chloride, N,N'-bis(trimethylsilyl)urea, N,O-bis(trimethylsilyl)trifluoroacetamide, trimethylsilyl trifluoromethanesulfonate, 1,3-dichloro-1,1,3,3-tetraisopropyldisiloxane, trimethylsilylacetylene, hexamethyldisilane, 3-isocyanatopropyltriethoxysilane, tetraisocyanatosilane, methyltriisocyanatosilane, and vinyltriisocyanatosilane.

In general, it is known that, in a sol-gel reaction, the bonding state of a siloxane bond to be produced varies depending on the acidity of a reaction medium. Specifically, when the reaction medium is acidic, a hydrogen ion is electrophilically added to oxygen of one reactive group (for example, an alkoxy group). Then, an oxygen atom in a water molecule is coordinated to a silicon atom to become a hydroxy group through a substitution reaction. When water exists sufficiently, one hydrogen ion reacts with one oxygen of the reactive group (for example, an alkoxy group). Therefore, when the content of the hydrogen ion in the medium and the amount of the reactive group reduce along with the advance of the reaction, the substitution reaction to the hydroxy group becomes slow. Thus, a polycondensation reaction occurs before all the reactive groups bonded to silane are subjected to hydrolysis, and hence a one-dimensional linear polymer or a two-dimensional polymer is produced relatively easily.

Meanwhile, when the medium is alkaline, a hydroxide ion is added to silicon to form a five-coordinated intermediate. Therefore, all the reactive groups (for example, alkoxy groups) are easily eliminated to be easily substituted by a silanol group. In particular, when a silicon compound having three or more reactive groups is used in the same silane, hydrolysis and polycondensation occur three-dimensionally, to thereby form an organosilicon polymer having a large number of three-dimensional crosslinking bonds. Further, the reaction is finished within a short time period.

Thus, in order to form an organosilicon polymer, it is preferred that the sol-gel reaction be advanced in the reaction medium under an alkaline state. When an organosilicon polymer is produced in an aqueous medium, specifically, it is preferred that the reaction be advanced at a pH of 8.0 or more. With this, an organosilicon polymer having higher strength and being excellent in durability can be formed. In addition, the sol-gel reaction is preferably performed at a reaction temperature of 85° C. or more and for a reaction time of 5 hours or more. When the sol-gel reaction is performed at the above-mentioned reaction temperature and for the above-mentioned reaction time, the formation of coalesced particles resulting from bonding between molecules of the silane compound in a sol or gel state on the surface of each of the toner particles can be suppressed.

Components that the toner particles each contain are described below.

In the present invention, the toner particles each having a surface layer each contain a binder resin or a polymer of a polymerizable monomer, and a colorant, and as required, any other component.

[Binder Resin]

An amorphous resin that has been generally used as a binder resin for toner particles may be used as the binder resin. Specifically, a styrene-acrylic resin (e.g., a styrene-acrylate copolymer or a styrene-methacrylate copolymer), a polyester, an epoxy resin, a styrene-butadiene copolymer, or the like may be used.

The colorant to be used in each of the toner particles according to the present invention is not particularly limited, and known colorants to be described below may each be used.

As yellow pigments, there are used yellow iron oxide, naples yellow, naphthol yellow S, hansa yellow G, hansa yellow 10G, benzidine yellow G, benzidine yellow GR, quinoline yellow lake, permanent yellow NCG, tartrazine lake, and other condensed azo compounds, isoindolinone compounds, anthraquinone compounds, azo metal complexes, methine compounds, and allyl amide compounds. Specific examples thereof include C.I. Pigment Yellow 12, 13, 14, 15, 17, 62, 74, 83, 93, 94, 95, 109, 110, 111, 128, 129, 147, 155, 168, and 180.

As orange pigments, there are given permanent orange GTR, pyrazolone orange, vulcan orange, benzidine orange G, indanthrene brilliant orange RK, and indanthrene brilliant orange GK.

As red pigments, there are given colcothar, permanent red 4R, lithol red, pyrazolone red, watching red calcium salt, lake red C, lake red D, brilliant carmine 6B, brilliant carmine 3B, eosin lake, rhodamine lake B, alizarin lake, and other condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples thereof include C.I. Pigment Red 2, 3, 5, 6, 7, 23, 48:2, 48:3, 48:4, 57:1, 81:1, 122, 144, 146, 166, 169, 177, 184, 185, 202, 206, 220, 221, and 254.

As blue pigments, there are given alkali blue lake, Victoria blue lake, phthalocyanine blue, metal-free phthalocyanine blue, partially chlorinated phthalocyanine blue, fast sky blue, indanthrene blue BG, and other copper phthalocyanine compounds and derivatives thereof, anthraquinone compounds, and basic dye lake compounds. Specific examples thereof include C.I. Pigment Blue 1, 7, 15, 15:1, 15:2, 15:3, 15:4, 60, 62, and 66.

As violet pigments, there are given fast violet B and methyl violet lake.

As green pigments, there are given Pigment Green B, malachite green lake, and final yellow green G. As white pigments, there are given zinc white, titanium oxide, antimony white, and zinc sulfide.

As black pigments, there are given carbon black, aniline black, nonmagnetic ferrite, magnetite, and pigments toned to black with the yellow colorants, the red colorants, and the blue colorants. One kind of those colorants may be used alone, or two or more kinds thereof may be used as a mixture, and in the state of a solid solution.

The content of the colorant is preferably from 3.0 parts by mass to 15.0 parts by mass with respect to 100 parts by mass of the binder resin or the polymer of the polymerizable monomer.

The toner particles may each contain a release agent. Examples of the release agent include: petroleum-based waxes, such as a paraffin wax, a microcrystalline wax, and petrolatum, and derivatives thereof; a Montan wax and derivatives thereof; a hydrocarbon wax produced by a Fischer-Tropsch process and derivatives thereof; polyolefin waxes, such as polyethylene and polypropylene, and derivatives thereof; natural waxes, such as a carnauba wax and a candelilla wax, and derivatives thereof; higher aliphatic alcohols; fatty acids, such as stearic acid and palmitic acid, or compounds, acid amide waxes, ester waxes, or ketones thereof; a hydrogenated castor oil and derivatives thereof; plant waxes; animal waxes; and silicone resins. The derivatives include oxides, and block copolymerization products or graft-modified products with vinyl-based monomers. One kind of those release agents may be used alone, or two or more kinds thereof may be used as a mixture.

The toner particles may each contain a charge control agent, and a known charge control agent may be used. The addition amount of such charge control agent is preferably from 0.01 part by mass to 10.00 parts by mass with respect to 100 parts by mass of the binder resin or the polymer of the polymerizable monomer.

A toner having such surface layer as specified in the present invention can obtain excellent development durability even when the sticking or adhesion of organic fine particles or inorganic fine particles is not performed. However, the performance of the sticking or adhesion of the organic fine particles or the inorganic fine particles is not excluded. The organic fine particles or the inorganic fine particles each preferably have a particle diameter 1/10 or less of the weight-average particle diameter of the toner particles from the viewpoint of the durability of the toner.

For example, the following fine particles are used as the organic fine particles or the inorganic fine particles.

(1) Fluidity imparting agents: silica, alumina, titanium oxide, carbon black, and carbon fluoride.

(2) Abrasives: metal oxides (such as strontium titanate, cerium oxide, alumina, magnesium oxide, and chromium oxide), nitrides (such as silicon nitride), carbides (such as silicon carbide), and metal salts (such as calcium sulfate, barium sulfate, and calcium carbonate).

(3) Lubricants: fluorine-based resin powders (such as vinylidene fluoride and polytetrafluoroethylene) and fatty acid metal salts (such as zinc stearate and calcium stearate).

(4) Charge controllable particles: metal oxides (such as tin oxide, titanium oxide, zinc oxide, silica, and alumina) and carbon black.

The surfaces of the toner particles may be treated with the organic fine particles or the inorganic fine particles for an improvement in flowability of the toner and the uniformization of the charging thereof. Examples of a treatment agent for the hydrophobic treatment of the organic fine particles or the inorganic fine particles include an unmodified silicone varnish, various modified silicone varnishes, an unmodified silicone oil, various modified silicone oils, a silane compound, a silane coupling agent, other organosilicon compounds, and an organotitanium compound. One kind of those treatment agents may be used alone, or two or more kinds thereof may be used in combination.

Specific methods of producing the toner particles are described below, but the methods of the present invention is not limited thereto.

A first production method is a method involving granulating a polymerizable monomer composition containing a polymerizable monomer, the colorant, the resin, and the organosilicon compounds in the aqueous medium to polymerize the polymerizable monomer to provide the toner particles according to the present invention (hereinafter sometimes referred to as "suspension polymerization method"). In the toner particles, the layer containing the organosilicon polymer can be formed on the surface of each of the toner particles because the organosilicon compounds are polymerized in a state of being deposited on the surface of each of the toner particles. In addition, the method has an advantage in that the organosilicon compounds are uniformly deposited with ease.

A second production method is a method involving producing a toner base and then forming the surface layer of the organosilicon polymer in the aqueous medium. The toner base may be obtained by melting and kneading the binder resin and the colorant, and pulverizing the resultant, or may be obtained by aggregating binder resin particles and colorant particles in the aqueous medium, and associating the aggregate. In addition, the toner base may be obtained by: suspending an organic phase dispersion liquid, which is produced by dissolving the binder resin and the colorant in an organic solvent, in the aqueous medium; granulating and polymerizing the resultant; and then removing the organic solvent.

A third production method is a method of producing the toner particles involving: suspending an organic phase dispersion liquid, which is produced by dissolving or dispersing the binder resin, the organosilicon compounds, and the colorant in an organic solvent, in the aqueous medium; granulating and polymerizing the resultant; and then removing the organic solvent. Also in this method, the organosilicon compounds are polymerized in a state of being deposited on the surface of each of the toner particles.

A fourth production method is a method involving: aggregating binder resin particles, colorant particles, and organosilicon compound-containing particles in a sol or gel state in the aqueous medium; and associating the aggregate to form the toner particles.

A fifth production method is a method involving: spraying a solvent containing the organosilicon compounds onto the surface of a toner base by a spray-dry method; and polymerizing or drying the surface by means of hot air and cooling to form the surface layer containing the organosilicon compounds. The toner base may be obtained by melting and kneading the binder resin and the colorant, and pulverizing the resultant, or may be obtained by aggregating the binder resin particles and the colorant particles in the aqueous medium, and associating the aggregate. In addition, the toner base may be obtained by: suspending an organic phase dispersion liquid, which is produced by dissolving the binder resin and the colorant in an organic solvent, in the aqueous medium; granulating and polymerizing the resultant; and then removing the organic solvent.

Preferred examples of the aqueous medium in the present invention include water, alcohols, such as methanol, ethanol, and propanol, and mixed solvents thereof.

Of the above-mentioned production methods, a suspension polymerization method serving as the first production method is preferred as a method of producing the toner particles from the viewpoint of the uniformity of the layer containing the organosilicon polymer on the surface of each of the toner particles. In the suspension polymerization method, the organosilicon polymer is uniformly deposited on the surface of each of the toner particles with ease, an adhesive property between the surface layer and inside of each of the toner particles is excellent, and the environmental stability and charge quantity-reversing component-suppressing effect of the toner, and the durable sustainability of each of the stability and the effect are satisfactory. The suspension polymerization method is further described below.

A release agent or any other resin may be added to the polymerizable monomer composition to be used in the suspension polymerization method as required. In addition, after the completion of a polymerizing step, produced particles are washed, recovered by filtration, and dried to provide the toner particles. The temperature of a reaction system may be increased in the latter half of the polymerizing step. Further, in order that an unreacted polymerizable monomer or a by-product may be removed, part of a dispersion medium may be distilled off from the reaction system in the latter half of the polymerizing step or after the completion of the polymerizing step.

The following resins may be used as the other resins as long as the effects of the present invention are not affected: homopolymers of styrene and substituted styrenes, such as polystyrene and polyvinyltoluene; styrene-based copolymers, such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-vinyl methyl ether copolymer, a styrene-vinyl ethyl ether copolymer, a styrene-vinyl methyl ketone copolymer, a styrene-butadiene copolymer, a styrene-isoprene copolymer, a styrene-maleic acid copolymer, and a styrene-maleate copolymer; and polymethyl methacrylate, polybutyl methacrylate, polyvinyl acetate, polyethylene, polypropylene, polyvinyl butyral, a silicone resin, a polyester resin, a polyamide resin, an epoxy resin, a polyacrylic resin, rosin, modified rosin, a terpene resin, a phenol resin, an aliphatic or alicyclic hydrocarbon resin, and an aromatic petroleum resin. One kind of those resins may be used alone, or two or more kinds thereof may be used as a mixture.

Preferred examples of the polymerizable monomer in the suspension polymerization method may include the following vinyl-based polymerizable monomers: styrene; styrene derivatives, such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, and p-phenylstyrene; acrylic polymerizable monomers, such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; methacrylic polymerizable monomers, such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate; methylene aliphatic monocarboxylic acid esters; vinyl esters, such as vinyl acetate, vinyl propionate, vinyl benzoate, vinyl butyrate, vinyl benzoate, and vinyl formate; vinyl ethers, such as vinyl methyl ether, vinyl ethyl ether, and vinyl isobutyl ether; and vinyl methyl ketone, vinyl hexyl ketone, and vinyl isopropyl ketone.

Of those vinyl polymers, a styrene polymer, a styrene-acrylic copolymer, and a styrene-methacrylic copolymer are preferred.

In addition, a polymerization initiator may be added in the polymerization of the polymerizable monomer. Examples of the polymerization initiator include: azo-based or diazo-based polymerization initiators, such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile; and peroxide-based polymerization initiators, such as benzoyl peroxide, methyl ethyl ketone peroxide, diisopropyl peroxydicarbonate, cumene hydroperoxide, 2,4-dichlorobenzoyl peroxide, and lauroyl peroxide. Any such polymerization initiator is preferably added in an amount of from 0.5 mass % to 30.0 mass % with respect to the polymerizable monomer. One kind of those polymerization initiators may be used alone, or two or more kinds thereof may be used in combination.

In addition, in order to control the molecular weight of the binder resin forming each of the toner particles, a chain transfer agent may be added in the polymerization of the polymerizable monomer. The chain transfer agent is preferably added in an amount of from 0.001 mass % to 15.000 mass % with respect to the polymerizable monomer.

Meanwhile, in order to control the molecular weight of the binder resin forming each of the toner particles, a crosslinkable monomer may be added in the polymerization of the polymerizable monomer. Examples of the crosslinkable monomer include: divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, diacrylates of polyethylene glycols #200, #400, and #600, dipropylene glycol diacrylate, polypropylene glycol diacrylate, a polyester-type diacrylate (MANDA manufactured by Nippon Kayaku Co., Ltd.), and methacrylate compounds corresponding to the above-mentioned acrylates.

As a polyfunctional crosslinkable monomer, there are given: pentaerythritol triacrylate, trimethylolethane triacrylate, trimethylolpropane triacrylate, tetramethylolmethane tetraacrylate, oligoester acrylate, and methacrylates thereof, 2,2-bis(4-methacryloxy polyethoxyphenyl)propane, diallyl phthalate, triallyl cyanurate, triallyl isocyanurate, triallyl trimellitate, and diallyl chlorendate. The polyfunctional crosslinkable monomer is preferably added in an amount of from 0.001 mass % to 15.000 mass % with respect to the polymerizable monomer.

When the medium to be used in the suspension polymerization is an aqueous medium, the following may be used as a dispersion stabilizer for particles of the polymerizable monomer composition: tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, and alumina. In addition, as an organic dispersant, there are given polyvinyl alcohol, gelatin, methylcellulose, methylhydroxypropylcellulose, ethylcellulose, carboxymethylcellulose sodium salt, and starch.

In addition, a commercially available nonionic, anionic, or cationic surfactant may also be utilized. Examples of such surfactant include sodium dodecyl sulfate, sodium tetradecyl sulfate, sodium pentadecyl sulfate, sodium octyl sulfate, sodium oleate, sodium laurate, and potassium stearate.

Various measurement methods related to the present invention are described below.

<Density (Atomic %) of Silicon Atom Present in Surface of Each of Toner Particles>

The density (atomic %) of a silicon atom present in the surface of each of the toner particles in the present invention was calculated by performing surface composition analysis based on X-ray photoelectron spectroscopic analysis (ESCA).

In the present invention, an apparatus and measurement conditions for ESCA are as described below. Used apparatus: Quantum 2000 manufactured by Ulvac-Phi, Inc. X-ray photoelectron spectrometer measurement conditions: X-ray source: Al Kα
X-ray: 100 am, 25 W, 15 kV
Raster: 300 μm×200 μm
Pass energy: 58.70 eV
Step size: 0.125 eV
Neutralization electron gun: 20 μA, 1 V
Ar ion gun: 7 mA, 10 V
Number of sweeps: Si: 15 sweeps, C: 10 sweeps In the present invention, the surface atom density (atomic %) was calculated from the measured peak intensity of each atom with a relative sensitivity factor provided by Ulvac-Phi, Inc.

<Method of Measuring Weight-Average Particle Diameter (D4) of Toner Particles>

The weight-average particle diameter (D4) of the toner particles is calculated as described below. A precision particle size distribution measuring apparatus based on a pore electrical resistance method including a 100 μm aperture tube "Coulter Counter Multisizer 3" (trademark, manufactured by Beckman Coulter, Inc.), and dedicated software included therewith "Beckman Coulter Multisizer 3 Version 3.51" (manufactured by Beckman Coulter, Inc.) for setting measurement conditions and analyzing measurement data are used. The measurement is performed with the number of effective measurement channels of 25,000, and the measured data are analyzed to calculate the D4.

An electrolyte aqueous solution prepared by dissolving special grade sodium chloride in ion-exchanged water so as to have a concentration of about 1 mass %, for example, "ISOTON II" (manufactured by Beckman Coulter, Inc.) may be used in the measurement.

The dedicated software is set as described below prior to the measurement and the analysis.

In the "Change Standard Operating Method (SOM)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a "Threshold/Measure Noise Level" button. In addition, a current is set to 1,600 μA, a gain is set to 2, and an electrolyte solution is set to ISOTON II, and a check mark is placed in a check box "Flush Aperture Tube after Each Run."

In the "Convert Pulses to Size Settings" screen of the dedicated software, a bin spacing is set to a logarithmic particle diameter, the number of particle diameter bins is set to 256, and a particle diameter range is set to 2 μm or more and 60 μm or less.

A specific measurement method is as described below.

(1) About 200 ml of the electrolyte aqueous solution is charged into a 250 ml round-bottom beaker made of glass dedicated for Multisizer 3. The beaker is set in a sample stand, and the electrolyte aqueous solution in the beaker is stirred with a stirrer rod at 24 rotations/sec in a counter-clockwise direction. Then, dirt and bubbles in the aperture tube are removed by the "Flush Aperture" function of the dedicated software.

(2) About 30 ml of the electrolyte aqueous solution is charged into a 100 ml flat-bottom beaker made of glass. About 0.3 ml of a diluted solution prepared by diluting "Contaminon N" (10 mass % aqueous solution of a neutral detergent for washing a precision measuring device formed of a nonionic surfactant, an anionic surfactant, and an organic builder, and having a pH of 7, manufactured by Wako Pure Chemical Industries, Ltd.) with ion-exchanged water by three mass fold is added as a dispersant to the electrolyte aqueous solution.

(3) A predetermined amount of ion-exchanged water is charged into the water tank of an ultrasonic dispersing unit "Ultrasonic Dispersion System Tetora 150" (manufactured by Nikkaki Bios Co., Ltd.) in which two oscillators each having an oscillatory frequency of 50 kHz are built so as to be out of phase by 180° and which has an electrical output of 120 W. About 2 ml of the Contaminon N is added to the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte aqueous solution in the beaker may resonate with an ultrasonic wave from the ultrasonic dispersing unit to the fullest extent possible.

(5) About 10 mg of the toner particles is gradually added to and dispersed in the electrolyte aqueous solution in the beaker in the section (4) under a state in which the electrolyte aqueous solution is irradiated with the ultrasonic wave. Then, the ultrasonic dispersion treatment is continued for an additional 60 seconds. The temperature of water in the water tank is appropriately adjusted so as to be 10° C. or more and 40° C. or less at the time of the ultrasonic dispersion.

(6) The electrolyte aqueous solution in the section (5) having dispersed therein the toner particles is dropped with a pipette to the round-bottom beaker in the section (1) placed in the sample stand, and the concentration of the toner particles to be measured is adjusted to about 5%. Then, measurement is performed until the particle diameters of 50,000 particles are measured.

(7) The measurement data is analyzed with the dedicated software included with the apparatus, and the weight-average particle diameter (D4) is calculated. The "Average Diameter" on the "Analysis/Volume Statistics (Arithmetic Average)" screen of the dedicated software when the dedicated software is set to show a graph in a vol % unit is the weight-average particle diameter (D4).

<Identification Method for Partial Structures Represented by Formulae (1) and (2)>

In the present invention, the unit of a hydrocarbon group bonded to a silicon atom out of the partial structures represented by the formulae (1) and (2) was identified by $^{13}$C-NMR (solid) measurement. Measurement conditions and a sample preparation method are described below.

"$^{13}$C-NMR (Solid) Measurement Conditions" Apparatus: JNM-ECX 500 II manufactured by JEOL Resonance Inc.
Sample tube: 3.2 mmφ
Sample: tetrahydrofuran-insoluble matter of toner particles for NMR measurement (its preparation method is described below): 150 mg
Measurement temperature: room temperature
Pulse mode: CP/MAS
Measured nucleus frequency: 123.25 MHz ($^{13}$C)

Reference substance: adamantane (external reference: 29.5 ppm)
Sample spinning rate: 20 kHz
Contact time: 2 ms
Delay time: 2 s
Number of scans: 1,024 scans "Sample Preparation Method"

Preparation of measurement sample: 10.0 g of toner particles are weighed and loaded into an extraction thimble (No. 86R manufactured by Toyo Roshi Kaisha, Ltd.). The toner particles are subjected to a Soxhlet extractor and extracted with 200 ml of tetrahydrofuran serving as a solvent for 20 hours. The filter residue in the extraction thimble is vacuum-dried at 40° C. for several hours, and the resultant is used as a sample for NMR measurement.

In the present invention, when an organic fine powder or an inorganic fine powder is externally added to the toner, a product obtained by removing the organic fine powder or the inorganic fine powder by the following method is used as the sample.

160 g of sucrose (manufactured by Kishida Chemical Co., Ltd.) is loaded into 100 mL of ion-exchanged water, and is dissolved while being heated in a water bath. Thus, a sucrose concentrated solution is prepared. 31 g of the sucrose concentrated solution and 6 mL of Contaminon N (10 mass % aqueous solution of a neutral detergent for washing a precision measuring device formed of a nonionic surfactant, an anionic surfactant, and an organic builder, and having a pH of 7, manufactured by Wako Pure Chemical Industries, Ltd.) are loaded into a centrifugation tube. 1.0 g of the toner is added to the mixture, and a toner lump is broken with a spatula or the like.

The centrifugation tube is shaken with a shaker at 350 strokes per min (spm) for 20 minutes. After the shaking, the solution is transferred into a glass tube for a swing rotor (50 mL), and is centrifuged with a centrifugal separator under the conditions of 3,500 rpm and 30 minutes. Through the operation, the base particles and external additive of the toner are separated from each other. It is visually confirmed that the toner and the aqueous solution have been sufficiently separated from each other, and the toner separated into the uppermost layer is collected with a spatula or the like. The collected toner is filtered with a vacuum filter and then dried with a drier for 1 hour or more. Thus, the measurement sample is obtained. A required amount is secured by performing the operation a plurality of times.

In the case of the partial structure represented by the formula (1), the presence of the partial structure represented by the formula (1) was confirmed by the presence or absence of a signal resulting from a methyl group (Si—$CH_3$), an ethyl group (Si—$C_2H_5$), a propyl group (Si—$C_3H_7$), a butyl group (Si—$C_4H_9$), a pentyl group (Si—$C_5H_{11}$), a hexyl group (Si—$C_6H_{13}$), or a phenyl group (Si—$C_6H_5$) bonded to a silicon atom.

<Method of Measuring Ratio Between Areas of Peaks Assigned to Partial Structures Represented by Formulae (1) and (2) Measured in $^{29}$Si-NMR of Tetrahydrofuran-Insoluble Matter of Toner Particles>

In the present invention, the $^{29}$Si-NMR (solid) measurement of the tetrahydrofuran-insoluble matter of the toner particles was performed under the following measurement conditions.

"$^{29}$Si-NMR (Solid) Measurement Conditions" Apparatus: JNM-ECX 500 II manufactured by JEOL Resonance Inc.
Sample tube: 3.2 mmφ
Sample: tetrahydrofuran-insoluble matter of toner particles for NMR measurement (its preparation method is described below): 150 mg
Measurement temperature: room temperature
Pulse mode: CP/MAS
Measured nucleus frequency: 97.38 MHz ($^{29}$Si)
Reference substance: DSS (external reference: 1.534 ppm)
Sample spinning rate: 10 kHz
Contact time: 10 ms
Delay time: 2 s
Number of scans: 2,000 scans to 8,000 scans After the measurement, a plurality of silane components having different substituents and different bonded groups in the tetrahydrofuran-insoluble matter of the toner particles were subjected to peak separation into an X1 structure, an X2 structure, an X3 structure, and an X4 structure shown below by curve fitting, and the areas of the respective peaks were calculated.

X1 structure represented by the formula (10): (Ri)(Rj)(Rk)$SiO_{1/2}$
X2 structure represented by the formula (11): (Rg)(Rh)Si$(O_{1/2})_2$
X3 structure represented by the formula (12): $RmSi(O_{12})_3$
X4 structure represented by the formula (13): $Si(O_1/2)_4$ Formula (10)

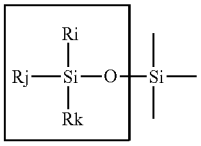

Formula (11)

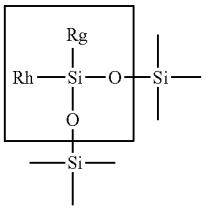

Formula (12)

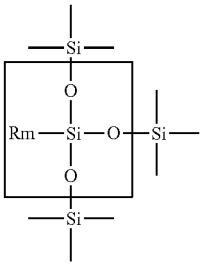

Formula (13)

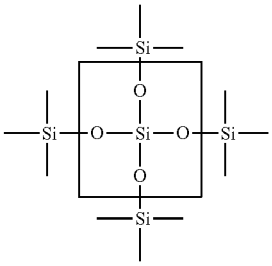

In the formulae (10) to (12), Ri, Rj, Rk, Rg, Rh, and Rm each represent an organic group, a halogen atom, a hydroxy group, or an alkoxy group bonded to a silicon atom.

In the formulae (10) to (13), the structures of portions surrounded by quadrangles are the X1 structure to the X4 structure, respectively.

Figure 1B:
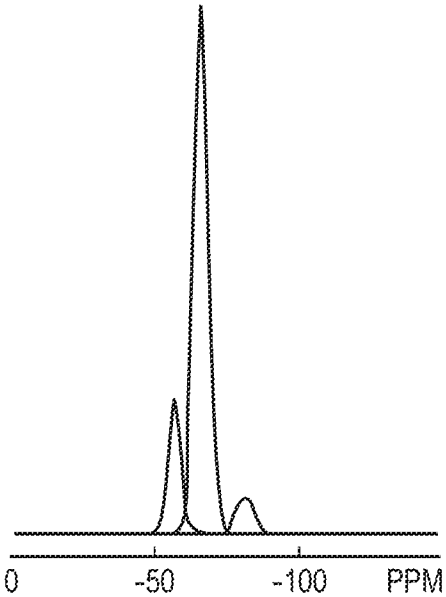
FIG. 1B shows the splitting of the peak by curve fitting in a chart which is measured by the $^{29}$Si-NMR of the toner particles according to the present invention.
Figure 1C:
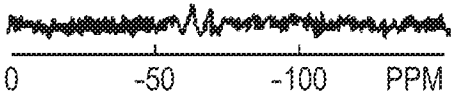
FIG. 1C shows a difference obtained by subtracting the split peaks shown in FIG. 1B from the peak of the measurement result shown in FIG. 1A.

In the present invention, in such chart obtained by the $^{2}$Si-NMR measurement of the tetrahydrofuran-insoluble matter of the toner particles as shown in FIG. 1A, a plurality of silane components having different substituents and different bonded groups in the X3 structure were specified by chemical shift values. The components were subjected to peak separation by curve fitting as shown in FIG. 1B, and the areas of the peaks were determined. Specifically, the area RT3 of the peak assigned to the partial structure represented by the formula (1) and the area RfT3 of the peak assigned to the partial structure represented by the formula (2) were each determined, and a ratio between the areas was calculated. As shown in FIG. 1C, a difference obtained by subtracting the split peaks shown in FIG. 1B from the peak of the measurement result shown in FIG. 1A is extremely small. Thus, the fitting was properly performed by the curve fitting.

When the partial structures represented by the formulae (1) and (2) need to be identified in more detail, the identification may be performed by using the result of $^{1}$H-NMR measurement in combination with the results of the $^{13}$C-NMR measurement and the $^{29}$Si-NMR measurement.

The present invention is described below in more detail by way of specific production examples, Examples, and Comparative Examples. However, the present invention is by no means limited thereto.

Production Example of Polyester (1)

Terephthalic acid: 11.1 mol

Adduct of bisphenol A with 2 mol of propylene oxide (PO-BPA): 10.9 mol

The monomers were loaded into an autoclave together with an esterification catalyst, and the autoclave was mounted with a decompression apparatus, a water-separating apparatus, a nitrogen gas-introducing apparatus, a temperature-measuring apparatus, and a stirring apparatus. Under a nitrogen atmosphere, while a pressure in the autoclave was reduced, the mixture was subjected to a reaction in accordance with an ordinary method at 215° C. until a Tg of 70° C. was obtained. Thus, a polyester (1) was obtained. The resultant polyester (1) had a weight-average molecular weight (Mw) of 7,930 and a number-average molecular weight (Mn) of 3,090.

Production Example of Polyester (2)

| | |
|---|---|
| Adduct of bisphenol A with 2 mol of ethylene oxide | 725 parts by mass |
| Phthalic acid | 285 parts by mass |
| Dibutyltin oxide | 2.5 parts by mass |

The foregoing materials were subjected to a reaction with stirring at 220° C. for 7 hours and further subjected to a reaction under reduced pressure for 5 hours. Then, the resultant was cooled to 80° C. and subjected to a reaction with 190 parts by mass of isophorone diisocyanate in ethyl acetate for 2 hours. Thus, an isocyanate group-containing polyester resin was obtained. 25 parts by mass of the isocyanate group-containing polyester resin and 1 part by mass of isophorone diamine were subjected to a reaction at 50° C. for 2 hours, to thereby provide a polyester (2) containing, as a main component, polyester containing a urea group. The resultant polyester (2) had a weight-average molecular weight (Mw) of 22,990, a number-average molecular weight (Mn) of 3,020, and a peak molecular weight of 6,810.

Production Example of Toner Particles 1

700 parts by mass of ion-exchanged water, 1,000 parts by mass of a 0.1 mol/l $Na_3PO_4$ aqueous solution, and 24.0 parts by mass of a 1.0 mol/1 HCl aqueous solution were added to a five-necked pressure-resistant vessel with a reflux tube, a stirrer, a temperature gauge, and a nitrogen-introducing tube. The mixture was kept at 63° C. with stirring at 12,000 rpm through the use of a high-speed stirring apparatus T.K. HOMO MIXER (manufactured by Tokushu Kika Kogyo Co., Ltd.). 85 parts by mass of a 1.0 mol/L $CaCl_2$ aqueous solution was gradually added to the resultant. Thus, an aqueous dispersion medium containing a fine poorly water-soluble dispersion stabilizer $Ca_3(PO_4)_2$ was prepared.

After that, a polymerizable monomer composition was produced by using the following raw materials. The step is a dissolving step.

| | |
|---|---|
| Styrene | 76.0 parts by mass |
| n-Butyl acrylate | 24.0 parts by mass |
| Divinylbenzene | 0.1 part by mass |
| Organosilicon compound A (methytriethoxysilane) | 9.0 parts by mass |
| Copper phthalocyanine pigment (Pigment Blue 15:3) | 6.5 parts by mass |
| Polyester (2) | 6.0 parts by mass |
| Charge control agent (aluminum compound of 3,5-di-tert-butylsalicylic acid) | 0.5 part by mass |
| Release agent (behenyl behenate) | 10.0 parts by mass |

The above-mentioned raw materials were dispersed with an attritor (manufactured by Mitsui Miike Chemical Engineering Machinery, Co., Ltd.) for 3 hours to provide a polymerizable monomer composition. Then, the polymerizable monomer composition was transferred into another vessel and kept at 62° C. for 5 minutes with stirring. Then, 20.0 parts by mass of t-butyl peroxypivalate (50% toluene solution) serving as a polymerization initiator was added to the polymerizable monomer composition, and the resultant was kept for 5 minutes with stirring. The step is a dissolving step (corresponding to the "step A1").

Then, the polymerizable monomer composition was loaded into the aqueous dispersion medium and granulated for 10 minutes with stirring with a high-speed stirring apparatus. The step is defined as a granulating step. After that, the high-speed stirring apparatus was changed to a propeller-type stirrer, and the temperature in the vessel was increased to 70° C. A time period required for the temperature increase was 10 minutes. Further, the resultant was subjected to a reaction for 5 hours with slow stirring. The pH was 5.1. The step is a reaction 1 step (corresponding to the "step B1").

After the completion of the reaction 1 step, 1.0 part by mass of the organosilicon compound B (vinyltriethoxysilane) was added (the addition corresponded to the "step C1"). The polymerization conversion ratio of the polymerizable monomer composition immediately before the loading of the organosilicon compound B was 91%.

Next, a 1.0 mol/l aqueous solution of NaOH was added to the resultant to adjust its pH to 8.1 within 10 minutes from the initiation of the addition of the aqueous solution of NaOH, and the temperature in the vessel was increased to 85° C. A time period required for the temperature increase was 20 minutes. After that, the temperature in the vessel was maintained at 85° C. for 5.0 hours (the maintenance corresponded to the "step D1"). A step from the completion of the reaction 1 step to the maintenance is a reaction 2 step.

Next, 300 parts by mass of ion-exchanged water was added to the vessel after the completion of the reaction 2 step. After that, 10% hydrochloric acid was added to the mixture to set its pH to 5.1 within 10 minutes from the initiation of the addition of the hydrochloric acid. Next, the reflux tube was removed and a distillation apparatus capable of recovering a fraction was mounted on the vessel. Next, the temperature in the vessel was increased to 100° C. A time period required for the temperature increase was 30 minutes. After that, the temperature in the vessel was maintained at 100° C. for 5.0 hours, and the remaining monomers and toluene were removed. A step from the mounting of the distillation apparatus capable of recovering a fraction to the completion of the maintenance of the temperature at 100° C. for 5.0 hours is a reaction 3 step.

Immediately after the completion of distillation, the resultant was cooled to 30° C., and dilute hydrochloric acid was added to the vessel to reduce the pH to 1.5 so that the dispersion stabilizer was dissolved. Further, filtration was performed. After the filtration, the resultant cake was not removed, 700 parts by mass of ion-exchanged water was further added, and the mixture was filtered again, followed by washing. Next, the cake after the filtration was removed and vacuum-dried at 30° C. for 1 hour. Further, fine and coarse powders were discarded by pneumatic classification. Thus, toner particles 1 were obtained. The formulation and production conditions of the resultant toner particles are shown in Table 1, and their physical properties are shown in Table 5.

Production Example of Toner Particles 22

An aqueous dispersion medium containing a poorly water-soluble dispersion stabilizer was prepared in the same manner as in the production example of the toner particles 1. After that, a polymerizable monomer composition was produced by using the following raw materials. The step is a dissolving step.

| | |
|---|---|
| Styrene | 76.0 parts by mass |
| n-Butyl acrylate | 24.0 parts by mass |
| Divinylbenzene | 0.1 part by mass |
| Copper phthalocyanine pigment (Pigment Blue 15:3) | 6.5 parts by mass |
| Polyester (2) | 5.0 parts by mass |
| Charge control agent (aluminum compound of 3,5-di-tert-butylsalicylic acid) | 0.4 part by mass |
| Release agent (behenyl behenate) | 10.0 parts by mass |

The above-mentioned raw materials were dispersed with an attritor (manufactured by Mitsui Miike Chemical Engineering Machinery, Co., Ltd.) for 3 hours to provide a polymerizable monomer composition. Then, the polymerizable monomer composition was transferred into another vessel and kept at 62° C. for 5 minutes with stirring. Then, 20.0 parts by mass of t-butyl peroxypivalate (50% toluene solution) serving as a polymerization initiator was added to the polymerizable monomer composition, and the resultant was kept for 5 minutes with stirring. The step is a dissolving step.

Then, the polymerizable monomer composition having added thereto the polymerization initiator was loaded into the aqueous dispersion medium and granulated for 10 minutes with stirring with a high-speed stirring apparatus. The step is a granulating step.

After that, the high-speed stirring apparatus was changed to a propeller-type stirrer, and the temperature in the vessel was increased to 70° C. A time period required for the temperature increase was 10 minutes. Further, the resultant was subjected to a reaction for 5 hours with slow stirring. The pH was 5.1. The step is a reaction 1 step.

After the completion of the reaction 1 step, 2.5 part by mass of the organosilicon compound B (vinyltriethoxysilane) was added (the addition corresponded to the "step A2"). The polymerization conversion ratio of the polymerizable monomer composition immediately before the loading of the organosilicon compound B was 92%.

Next, a 1.0 mol/l aqueous solution of NaOH was added to the resultant to adjust its pH to 8.1 within 10 minutes from the initiation of the addition of the aqueous solution of NaOH, and the temperature in the vessel was increased to 85° C. A time period required for the temperature increase was 20 minutes. After that, the temperature in the vessel was maintained at 85° C. for 5.0 hours. The step is a reaction 2 step (corresponding to the "step B2").

After the completion of the reaction 2 step, 8.0 parts by mass of the organosilicon compound A (methyltriethoxysilane) was added (the addition corresponded to the "step C2").

Next, 300 parts by mass of ion-exchanged water was added to the vessel after the completion of the reaction 2 step. After that, 10% hydrochloric acid was added to the mixture to set its pH to 5.1 within 10 minutes from the initiation of the addition of the hydrochloric acid. Next, the reflux tube was removed and a distillation apparatus capable of recovering a fraction was mounted on the vessel. Next, the temperature in the vessel was increased to 100° C. A time period required for the temperature increase was 30 minutes. After that, the temperature in the vessel was maintained at 100° C. for 5.0 hours, and the remaining monomers and toluene were removed. A step from the mounting of the distillation apparatus capable of recovering a fraction to the completion of the maintenance of the temperature at 100° C. for 5.0 hours is a reaction 3 step (corresponding to the "step D2").

After the completion of the reaction 3 step, toner particles 22 were obtained in the same manner as in the production example of the toner particles 1. The formulation and production conditions of the resultant toner particles are shown in Table 3, and their physical properties are shown in Table 5.

Production Examples of Toner Particles 2 and Toner Particles 4 to 19

Toner particles 2 and toner particles 4 to 19 were obtained in the same manner as in the production example of the toner particles 1 except that formulations and production conditions shown in Table 1, Table 2, and Table 3 were adopted. Distillation under reduced pressure was performed by mounting an empty neck with a decompression machine and reducing a pressure in the vessel to the extent that materials in the vessel were not drawn toward the distillation apparatus capable of recovering a fraction. The physical properties of the resultant particles are shown in Table 5.

Production Example of Toner Particles 3

In the production example of the toner particles 1, after the completion of the reaction 1 step, 0.5 part by mass of potassium persulfate was added as a water-soluble initiator simultaneously with the addition of 1.0 part by mass of the organosilicon compound B (vinyltriethoxysilane). In addition, the formulation and the production conditions were changed as shown in Table 1. Toner particles 3 were obtained in the same manner as in the production example of the toner particles 1 except the foregoing. The physical properties of the resultant particles are shown in Table 5.

Production Examples of Toner Particles 20, 21, 25, and 26

In the production example of the toner particles 1, in the dissolving step, the organosilicon compound B was added simultaneously with the organosilicon compound A, and after the completion of the reaction 1 step, the organosilicon compound B was not added. In addition, the formulation and the production conditions were changed as shown in Table 3. Toner particles 20, 21, 25, and 26 were obtained in the same manner as in the production example of the toner particles 1 except the foregoing. The physical properties of the resultant particles are shown in Table 5.

Production Examples of Comparative Toner Particles 1 to 6

In the production example of the toner particles 1, in the dissolving step, the organosilicon compound B was added simultaneously with the organosilicon compound A, and after the completion of the reaction 1 step, the organosilicon compound B was not added. In addition, the formulation and the production conditions were changed as shown in Table 4. Comparative toner particles 1 to 6 were obtained in the same manner as in the production example of the toner particles 1 except the foregoing. The physical properties of the resultant particles are shown in Table 5.

Production Example of Toner Particles 23

700 parts by mass of ion-exchanged water, 1,000 parts by mass of a 0.1 mol/l $Na_3PO_4$ aqueous solution, and 24.0 parts by mass of a 1.0 mol/l HCl aqueous solution were added to a five-necked pressure-resistant vessel with a reflux tube, a stirrer, a temperature gauge, and a nitrogen introducing tube. The mixture was kept at 63° C. with stirring at 12,000 rpm through the use of a high-speed stirring apparatus T.K. HOMO MIXER (manufactured by Tokushu Kika Kogyo Co., Ltd.). 85 parts by mass of a 1.0 mol/l $CaCl_2$ aqueous solution was gradually added to the resultant. Thus, an aqueous dispersion medium containing a fine poorly water-soluble dispersion stabilizer $Ca_3(PO_4)_2$ was prepared.

After that, a toner particle precursor composition was produced by using the following raw materials. The step is a dissolving step.

| | |
|---|---|
| Polyester (1) | 60.0 parts by mass |
| Polyester (2) | 40.0 parts by mass |
| Organosilicon compound A (methyltriethoxysilane) | 8.0 parts by mass |
| Copper phthalocyanine pigment (Pigment Blue 15:3) | 6.5 parts by mass |
| Charge control agent (aluminum compound of 3,5-di-tert-butylsalicylic acid) | 0.5 part by mass |
| Release agent (behenyl behenate) | 10.0 parts by mass |

The foregoing materials were dissolved in 400 parts by mass of toluene, and the temperature of the solution was increased to 63° C. Thus, a toner particle precursor composition was obtained.

Next, the composition was loaded into the aqueous dispersion medium, and the mixture was granulated for 5 minutes while being stirred with a high-speed stirring apparatus at 12,000 rpm. A step up to the foregoing is a granulating step (corresponding to the "step A1").

After that, the high-speed stirring apparatus was changed to a propeller-type stirrer, and the temperature in the vessel was increased to 70° C. A time period required for the temperature increase was 10 minutes. Further, the resultant was subjected to a reaction for 5 hours while being slowly stirred. The pH was 5.1 (the reaction corresponded to the "step B1").

Next, 2.0 parts by mass of the organosilicon compound B (vinyltriethoxysilane) was added (the addition corresponded to the "step C1").

After that, a 1.0 mol/l aqueous solution of NaOH was added to the resultant to adjust its pH to 8.1 within 10 minutes, and the temperature in the vessel was increased to 85° C. A time period required for the temperature increase was 20 minutes. After that, the temperature in the vessel was maintained at 85° C. for 6.0 hours (the maintenance corresponded to the "step D1").

Next, 300 parts by mass of ion-exchanged water was added to the vessel after the completion of the foregoing steps, and then 10% hydrochloric acid was added to the mixture to set its pH to 5.1 within 10 minutes from the initiation of the addition of the hydrochloric acid. Next, the reflux tube was removed, and a distillation apparatus capable of recovering a fraction was mounted on the vessel. Then, the temperature in the vessel was increased to 100° C. A time period required for the temperature increase was 30 minutes. After that, the temperature in the vessel was kept at 100° C. for 5.0 hours.

Immediately after the completion of the distillation, the vessel was cooled to 30° C., and dilute hydrochloric acid was added to the vessel to reduce the pH to 1.5 so that the dispersion stabilizer was dissolved. Further, filtration was performed. After the filtration, the resultant cake was not removed, 700 parts by mass of ion-exchanged water was further added, and the mixture was filtered again, followed by washing. Next, the cake after the filtration was removed and vacuum-dried at 30° C. for 1 hour. Further, fine and coarse powders were discarded by pneumatic classification. Thus, toner particles 23 were obtained. The physical properties of the resultant toner particles are shown in Table 5.

Production Example of Toner Particles 24

"Preparation of Resin Particle-Dispersed Liquid (1)"

| | |
|---|---|
| Polyester (1): | 100 parts by mass |
| Methyl ethyl ketone: | 50 parts by mass |
| Isopropyl alcohol: | 20 parts by mass |

Methyl ethyl ketone and isopropyl alcohol were loaded into a vessel. After that, the polyester (1) was gradually loaded into the vessel, and the mixture was stirred so that the polyester was completely dissolved. Thus, a polyester (1)-dissolved liquid was obtained. A temperature in the vessel containing the polyester (1)-dissolved liquid was set to 65° C., and a 10% aqueous solution of ammonia was gradually dropped so that its total amount became 5 parts by mass while the liquid was stirred. Further, 230 parts by mass of ion-exchanged water was gradually dropped at a rate of 10 ml/min to perform phase inversion emulsification. Further, desolvation was performed by reducing a pressure in the vessel with an evaporator. Thus, a resin particle-dispersed liquid (1) of the polyester (1) was obtained. The volume-average particle diameter of the resin particles of the liquid was 140 nm. In addition, the solid content of the resin particles was adjusted to 20% with ion-exchanged water.

"Preparation of Resin Particle-Dispersed Liquid (2)"

| | |
|---|---|
| Polyester (2): | 100 parts by mass |
| Methyl ethyl ketone: | 50 parts by mass |
| Isopropyl alcohol: | 20 parts by mass |

Methyl ethyl ketone and isopropyl alcohol were loaded into a vessel. After that, the polyester (2) was gradually loaded into the vessel, and the mixture was stirred so that the polyester was completely dissolved. Thus, a polyester (2)-dissolved liquid was obtained. A temperature in the vessel containing the polyester (2)-dissolved liquid was set to 40° C., and a 10% aqueous solution of ammonia was gradually dropped so that its total amount became 3.5 parts by mass while the liquid was stirred. Further, 230 parts by mass of ion-exchanged water was gradually dropped at a rate of 10 ml/min to perform phase inversion emulsification. Further, desolvation was performed by reducing a pressure in the vessel. Thus, a resin particle-dispersed liquid (2) of the polyester (2) was obtained. The volume-average particle diameter of the resin particles of the liquid was 160 nm. In addition, the solid content of the resin particles was adjusted to 20% with ion-exchanged water.

"Preparation of Colorant Particle-Dispersed Liquid 1"

| | |
|---|---|
| Copper phthalocyanine (Pigment Blue 15:3): | 45 parts by mass |
| Charge control agent: (aluminum compound of 3,5-di-tert-butylsalicylic acid) | 0.7 part by mass |
| Ionic surfactant NEOGEN RK (manufactured by DKS Co., Ltd.): | 5 parts by mass |
| Ion-exchanged water: | 190 parts by mass |

The foregoing components were mixed, and were dispersed with a homogenizer for 10 minutes. After that, the resultant was subjected to a dispersion treatment with ULTIMIZER (counter collision-type wet pulverizer: manufactured by Sugino Machine Limited) at a pressure of 250 MPa for 20 minutes. Thus, a colorant particle-dispersed liquid 1 having a volume-average particle diameter of colorant particles of 130 nm and a solid content of 20% was obtained.

"Preparation of Release Agent Particle-Dispersed Liquid"

| | |
|---|---|
| Behenyl behenate: | 60 parts by mass |
| Ionic surfactant NEOGEN RK (manufactured by DKS Co, Ltd.): | 2.0 parts by mass |
| Ion-exchanged water: | 240 parts by mass |

The foregoing materials were heated to 100° C., and were sufficiently dispersed with ULTRA-TURRAX T50 manufactured by IKA. After that, in a pressure ejection-type Gaulin homogenizer, the resultant was warmed to 115° C. and subjected to a dispersion treatment for 1 hour. Thus, a release agent particle-dispersed liquid having a volume-average particle diameter of 160 nm and a solid content of 20% was obtained.

"Production of Toner Particle Precursor"

| | |
|---|---|
| Resin particle-dispersed liquid (1): | 300 parts by mass |
| Resin particle-dispersed liquid (2): | 150 parts by mass |
| Colorant particle-dispersed liquid 1: | 39 parts by mass |
| Release agent particle-dispersed liquid: | 60 parts by mass |

After 2.2 parts by mass of an ionic surfactant NEOGEN RK had been added to a flask, the foregoing materials were stirred. Next, a 1 mol/l aqueous solution of nitric acid was dropped to the mixture to set its pH to 3.7. After that, 0.35 part by mass of polyaluminum sulfate was added to the mixture, and the whole was dispersed with ULTRA-TURRAX. While the flask was stirred in an oil bath for heating, the resultant was heated to 50° C. and held at the temperature for 40 minutes. Thus, a toner particle precursor was obtained.

Next, 8.0 parts by mass of the organosilicon compound A (methyltriethoxysilane) was added to the precursor (the step A1"), and a 1.0 mol/l aqueous solution of NaOH was added to the mixture to adjust its pH to 7.1 within 10 minutes from the initiation of the addition of the aqueous solution of NaOH. The flask was hermetically sealed, and the mixture was gradually heated to 90° C. while the stirring was continued, followed by the holding of the mixture at 90° C. for 5 hours (the holding corresponded to the "step B1").

After that, 2.0 parts by mass of the organosilicon compound B (vinyltriethoxysilane) was added to the resultant (the addition corresponded to the "step C1"), and the mixture was further held at 90° C. for 5 hours (the holding corresponded to the "step D1").

Next, 2.0 parts by mass of an ionic surfactant NEOGEN RK was added to the resultant, and the mixture was subjected to a reaction at 100° C. for 5 hours. After the completion of the reaction, a fraction was recovered at 85° C. by distillation under reduced pressure.

Immediately after the completion of the distillation, the fraction was cooled to 30° C. and further filtered. After the filtration, the resultant cake was not removed, 700 parts by mass of ion-exchanged water was further added, and the mixture was filtered again, followed by washing. The washing step was repeated five times.

Next, the cake after the filtration was removed and vacuum-dried at 30° C. for 1 hour. Further, fine and coarse powders were discarded by pneumatic classification. Thus, toner particles 24 were obtained. The physical properties of the resultant toner particles are shown in Table 5.

[Evaluations]

Each of the toner particles 1 to 26 and the comparative toner particles 1 to 6 thus obtained was used as a toner without being treated, and was subjected to the following evaluations.

<Measurement of Charge Quantity of Toner>

The charge quantity of a toner may be determined by a method to be described below. First, a toner to be evaluated and a standard carrier for a negatively chargeable toner (trade name: N-01, manufactured by The Imaging Society of Japan) are left to stand under each of the following environments for 24 hours: a low-temperature and low-humidity (L/L) environment (10° C./15% RH), a normal-temperature and normal-humidity (N/N) environment (25° C./50% RH), and a high-temperature and high-humidity (H/H) environment (32.5° C./85% RH). After the standing, the toner to be evaluated is mixed with the carrier so that its mass may account for 5 mass % of the mass of a mixture to be obtained, and the toner and the carrier are mixed with a Turbula mixer for 120 seconds. The mixture is defined as an initial developer. Next, 0.40 g of the initial developer is loaded into a metallic container having mounted on its bottom portion a conductive screen having an aperture of 20 μm, and is sucked with a suction machine, followed by the measurement of a difference between the mass of the developer before the suction and that after the suction, and an electric potential stored in a capacitor connected to the container. At this time, a suction pressure is set to 2.5 kPa. The triboelectric charge quantity of the toner is calculated from the following equation by using the mass difference, the stored electric potential, and the capacity of the capacitor. The charge quantity obtained here is defined as an initial charge quantity (mC/kg) under each of the environments.

The standard carrier for a negatively chargeable toner to be used in the measurement (trade name: N-01, manufactured by The Imaging Society of Japan) is passed through a 250-mesh screen before its use.

$$Q=C\times V/(W1-W2)$$

Q: The charge quantity of the toner
C (μF): The capacity of the capacitor
V (volt): The electric potential stored in the capacitor
W1−W2 (g): The difference between the mass before the suction and that after the suction In the present invention, the charge quantity was ranked as described below. The results are shown in Tables 6 to 9.
Rank A: The charge quantity is −35.0 mC/kg or less.
Rank B: The charge quantity is −30.0 mC/kg or less, but is more than −35.0 mC/kg.
Rank C: The charge quantity is −25.0 mC/kg or less, but is more than −30.0 mC/kg.
Rank D: The charge quantity is more than −25.0 mC/kg.

[Image Output Evaluation]

A tandem-type laser beam printer LBP9510C manufactured by Canon Inc. was remodeled so as to be capable of performing printing only with a cyan station. A toner cartridge for the LBP9510C was used and filled with 100 g of toner particles to be evaluated. Then, the toner cartridge was left to stand under each of the following environments for 24 hours: a low-temperature and low-humidity (L/L) environment (10° C./15% RH), a normal-temperature and normal-humidity (N/N) environment (25° C./50% RH), and a high-temperature and high-humidity (H/H) environment (32.5° C./85% RH). After having been left to stand under each of the environments for 24 hours, the toner cartridge was mounted on the LBP9510C, and an image having a print percentage of 1.0% was printed out on up to 10,000 sheets of A4 paper in a lateral direction. An image density, solid followability, and member contamination at an initial stage, and those at the time of the output on the 10,000 sheets (after long-term repeated use) were evaluated. The results are shown in Tables 6 to 9.

<Image Density Evaluation>

An image density at the initial stage or at the time of the output on the 10,000 sheets was evaluated. The evaluation was performed by: outputting a solid image through the use of XEROX BUSINESS 4200 (manufactured by Xerox Corporation, 75 g/m$^2$) as the paper; and measuring its density. The image density was obtained by measuring a density relative to an image in a white ground portion having an original density of 0.00 with a "Macbeth reflection densitometer RD918" (manufactured by Gretag Macbeth). In the evaluation of the present invention, the image density was ranked as described below.
A: The image density is 1.40 or more.
B: The image density is from 1.30 to 1.39.
C: The image density is from 1.25 to 1.29.
D: The image density is from 1.20 to 1.24.
E: The image density is 1.19 or less.

<Solid Followability Evaluation>

A solid image was output at the initial stage or at the time of the output on the 10,000 sheets, and solid followability was evaluated in accordance with the following criteria. XEROX BUSINESS 4200 (manufactured by Xerox Corporation, 75 g/m$^2$) was used as the paper. A density at a predetermined site was measured with a "Macbeth reflection densitometer RD918" (manufactured by Gretag Macbeth), and a density difference was calculated by subtracting the density from a density at a site distant from the leading end of the solid image by 50 mm.
A: The density difference is 0.05 or less in the entire range of the image.
B: In a range distant from the trailing end of the image by 50 mm or less, a site having a density difference of more than 0.05 and 0.15 or less is present. However, the following cases C to E are excluded.
C: In a range distant from the trailing end of the image by 50 mm or less, a site having a density difference of more than 0.15 is present, or in a range distant therefrom by more than 50 mm and 130 mm or less, a site having a density difference of more than 0.05 and 0.15 or less is present. However, the following cases D and E are excluded.
D: In a range distant from the trailing end of the image by more than 50 mm and 130 mm or less, a site having a density difference of more than 0.15 is present, or in a range distant therefrom by more than 130 mm, a site having a density difference of more than 0.05 and 0.15 or less is present. However, the following case E is excluded.
E: In a range distant from the trailing end of the image by more than 130 mm, a site having a density difference of more than 0.15 is present.

<Member Contamination Evaluation>

An image having a print percentage of 1.0% was printed out on up to 10,000 sheets of A4 paper in a lateral direction. After that, such a mix image that the former half portion of a printed image was a halftone image (toner laid-on level: 0.25 mg/cm$^2$), and the latter half portion thereof was a solid image (toner laid-on level: 0.40 mg/cm$^2$) was output. Member contamination was evaluated by using the output image in accordance with the following criteria. XEROX BUSINESS 4200 (manufactured by Xerox Corporation, 75 g/m$^2$) was used as the paper.
A: No melt adhesion product is observed on each of a developing roller and a photosensitive drum.
B: 1 or 2 thin stripes in a peripheral direction are observed on a developing roller, or 1 or 2 melt adhesion products are observed on a photosensitive drum.
C: 3 to 5 thin stripes in a peripheral direction are observed on a developing roller, or 3 to 5 melt adhesion products are observed on a photosensitive drum.
D: 6 to 20 thin stripes in a peripheral direction are, or such a stripe as to appear in the image is, observed on a developing roller. Alternatively, 6 to 20 melt adhesion products are, or such a melt adhesion product as to affect the image is, observed on a photosensitive drum.
E: 21 or more fine stripes in a peripheral direction are, or such a stripe as to largely appear in the image is, observed on a developing roller. Alternatively, 21 or more melt adhesion products are, or such a melt adhesion product as to largely affect the image is, observed on a photosensitive drum.

<Evaluation of Low-Temperature Fixability (Cold Offset End Temperature)>

The fixing unit of a laser beam printer LBP9510C manufactured by Canon Inc. was remodeled so that its fixation temperature could be adjusted. A fixed image having a toner laid-on level of 0.4 mg/cm$^2$ was formed with the LBP9510C after the remodeling at a process speed of 230 mm/sec. XEROX BUSINESS 4200 (manufactured by Xerox Corporation, 75 g/m$^2$) was used as transfer paper.

Fixability was evaluated as described below. The fixed image was rubbed with KimWipes [S-200 (Nippon Paper Crecia Co., Ltd.)] under a load of 75 g/cm$^2$ ten times, and the lowest temperature at which the percentage by which the density of the image was reduced by the rubbing became less than 5% was defined as a cold offset end temperature. The evaluation was performed under normal temperature and normal humidity (25° C./50% RH).

The toner particles shown in Tables 1 to 4 were each evaluated for an image density, solid followability, and member contamination. The results are shown in Tables 6 to 9.

TABLE 1

| | | | | Toner particles 1 | Toner particles 2 | Toner particles 3 | Toner particles 4 |
|---|---|---|---|---|---|---|---|
| Monomer composition | Binder resin | Styrene | Part(s) by mass | 76.0 | 76.0 | 76.0 | 76.0 |
| | | n-Butyl acrylate | Part(s) by mass | 24.0 | 24.0 | 24.0 | 24.0 |
| | Divinylbenzene | | Part(s) by mass | 0.1 | 0.1 | 0.1 | 0.1 |
| | Copper phthalocyanine pigment | | Part(s) by mass | 6.5 | 6.5 | 6.5 | 6.5 |
| | Polyester | | Part(s) by mass | 5.0 | 5.0 | 5.0 | 5.0 |
| | Charge control agent | | Part(s) by mass | 0.4 | 0.4 | 0.4 | 0.4 |
| | Charge control resin | | Part(s) by mass | 0.4 | 0.4 | 0.4 | 0.4 |
| | Release agent | | Part(s) by mass | 10.0 | 10.0 | 10.0 | 10.0 |
| Initiator | Oil-soluble initiator | | Part(s) by mass | 20.0 | 20.0 | 20.0 | 20.0 |
| | Water-soluble initiator | | Part(s) by mass | — | — | 0.5 | — |
| Organosilicon polymer | Organosilicon compound A | | Kind | Methyl-triethoxy-silane | Methyl-triethoxy-silane | Methyl-triethoxy-silane | Methyl-triethoxy-silane |
| | | | Part(s) by mass | 9.0 | 9.0 | 9.0 | 9.0 |
| | | | Addition timing | Dissolving step | Dissolving step | Dissolving step | Dissolving step |
| | Organosilicon compound B | | Kind | Vinyl-triethoxy-silane | Vinyl-triethoxy-silane | Vinyl-triethoxy-silane | Allyl-triethoxy-silane |
| | | | Part(s) by mass | 1.0 | 1.0 | 1.0 | 1.0 |
| | | | Addition timing | At time of completion of reaction 1 | At time of completion of reaction 1 | At time of completion of reaction 1 | At time of completion of reaction 1 |
| Production condition | Reaction 1 step | | pH | 5.1 | 5.1 | 5.1 | 5.1 |
| | | | Temperature | 70.0 | 70.0 | 70.0 | 70.0 |
| | | | Time | 5.0 | 7.0 | 5.0 | 5.0 |
| | Reaction 2 step | | pH | 8.1 | 8.1 | 8.1 | 8.1 |
| | | | Temperature | 85.0 | 85.0 | 85.0 | 85.0 |
| | | | Time | 6.5 | 6.5 | 6.5 | 6.5 |
| | Reaction 3 step | | pH | 5.1 | 5.1 | 5.1 | 5.1 |
| | | | Temperature | 100.0 | 100.0 | 100.0 | 100.0 |
| | | | Time | 5.0 | 5.0 | 5.0 | 5.0 |
| | | | Pressure | Normal pressure | Normal pressure | Normal pressure | Normal pressure |

| | | | | Toner particles 5 | Toner particles 6 | Toner particles 7 | Toner particles 8 |
|---|---|---|---|---|---|---|---|
| Monomer composition | Binder resin | Styrene | Part(s) by mass | 76.0 | 76.0 | 76.0 | 76.0 |
| | | n-Butyl acrylate | Part(s) by mass | 24.0 | 24.0 | 24.0 | 24.0 |
| | Divinylbenzene | | Part(s) by mass | 0.1 | 0.1 | 0.1 | 0.1 |
| | Copper phthalocyanine pigment | | Part(s) by mass | 6.5 | 6.5 | 6.5 | 6.5 |
| | Polyester | | Part(s) by mass | 5.0 | 5.0 | 5.0 | 5.0 |
| | Charge control agent | | Part(s) by mass | 0.4 | 0.4 | 0.4 | 0.4 |
| | Charge control resin | | Part(s) by mass | 0.4 | 0.4 | 0.4 | 0.4 |
| | Release agent | | Part(s) by mass | 10.0 | 10.0 | 10.0 | 10.0 |
| Initiator | Oil-soluble initiator | | Part(s) by mass | 20.0 | 20.0 | 20.0 | 20.0 |
| | Water-soluble initiator | | Part(s) by mass | — | — | — | — |
| Organosilicon polymer | Organosilicon compound A | | Kind | Ethyl-triethoxy-silane | Methyl-triethoxy-silane | Methyl-triethoxy-silane | Methyl-triethoxy-silane |
| | | | Part(s) by mass | 9.0 | 14.0 | 8.5 | 9.5 |
| | | | Addition timing | Dissolving step | Dissolving step | Dissolving step | Dissolving step |
| | Organosilicon compound B | | Kind | Vinyl-triethoxy-silane | Vinyl-triethoxy-silane | Vinyl-triethoxy-silane | Vinyl-triethoxy-silane |

TABLE 1-continued

| | | | | | | |
|---|---|---|---|---|---|---|
| | | Part(s) by mass | 1.0 | 1.0 | 1.5 | 0.5 |
| | | Addition timing | At time of completion of reaction 1 | At time of completion of reaction 1 | At time of completion of reaction 1 | At time of completion of reaction 1 |
| Production condition | Reaction 1 step | pH | 5.1 | 5.1 | 5.1 | 5.1 |
| | | Temperature | 70.0 | 70.0 | 70.0 | 70.0 |
| | | Time | 5.0 | 5.0 | 5.0 | 5.0 |
| | Reaction 2 step | pH | 8.1 | 8.1 | 8.1 | 8.1 |
| | | Temperature | 85.0 | 85.0 | 85.0 | 85.0 |
| | | Time | 6.5 | 7.5 | 6.5 | 6.5 |
| | Reaction 3 step | pH | 5.1 | 5.1 | 5.1 | 5.1 |
| | | Temperature | 100.0 | 100.0 | 100.0 | 100.0 |
| | | Time | 5.0 | 5.0 | 5.0 | 5.0 |
| | | Pressure | Normal pressure | Normal pressure | Normal pressure | Normal pressure |

TABLE 2

| | | | | Toner particles 9 | Toner particles 10 | Toner particles 11 | Toner particles 12 | Toner particles 13 |
|---|---|---|---|---|---|---|---|---|
| Monomer composition | Binder resin | Styrene | Part(s) by mass | 76.0 | 76.0 | 76.0 | 76.0 | 76.0 |
| | | n-Butyl acrylate | Part(s) by mass | 24.0 | 24.0 | 24.0 | 24.0 | 24.0 |
| | Divinylbenzene | | Part(s) by mass | 0.1 | 0.1 | 0.1 | 0.1 | 0.1 |
| | Copper phthalocyanine pigment | | Part(s) by mass | 6.5 | 6.5 | 6.5 | 6.5 | 6.5 |
| | Polyester-based resin | | Part(s) by mass | 5.0 | 5.0 | 5.0 | 5.0 | 5.0 |
| | Charge control agent | | Part(s) by mass | 0.4 | 0.4 | 0.4 | 0.4 | 0.4 |
| | Charge control resin | | Part(s) by mass | 0.4 | 0.4 | 0.4 | 0.4 | 0.4 |
| | Release agent | | Part(s) by mass | 10.0 | 10.0 | 10.0 | 10.0 | 10.0 |
| Initiator | Oil-soluble initiator | | Part(s) by mass | 20.0 | 20.0 | 20.0 | 20.0 | 20.0 |
| | Water-soluble initiator | | Part(s) by mass | — | — | — | — | — |
| Organosilicon polymer | Organosilicon compound A | | Kind | Methyl-triethoxy-silane | Hexyl-triethoxy-silane | Methyl-triethoxy-silane | Methyl-triethoxy-silane | Methyl-triethoxy-silane |
| | | | Part(s) by mass | 9.0 | 9.0 | 4.5 | 3.5 | 2.7 |
| | | | Addition timing | Dissolving step | Dissolving step | Dissolving step | Dissolving step | Dissolving step |
| | Organosilicon compound B | | Kind | p-Styryl-trimethoxy-silane | Vinyl-triethoxy-silane | Vinyl-triethoxy-silane | Vinyl-triethoxy-silane | Vinyl-triethoxy-silane |
| | | | Part(s) by mass | 1.0 | 1.0 | 0.5 | 0.5 | 0.3 |
| | | | Addition timing | At time of completion of reaction 1 | At time of completion of reaction 1 | At time of completion of reaction 1 | At time of completion of reaction 1 | At time of completion of reaction 1 |
| Production condition | Reaction 1 step | | pH | 5.1 | 5.1 | 5.1 | 5.1 | 5.1 |
| | | | Temperature | 70.0 | 70.0 | 70.0 | 70.0 | 70.0 |
| | | | Time | 5.0 | 5.0 | 5.0 | 5.0 | 5.0 |
| | Reaction 2 step | | pH | 8.1 | 8.1 | 8.1 | 8.1 | 8.1 |
| | | | Temperature | 85.0 | 85.0 | 85.0 | 85.0 | 85.0 |
| | | | Time | 6.5 | 6.5 | 6.5 | 6.5 | 6.5 |
| | Reaction 3 step | | pH | 5.1 | 5.1 | 5.1 | 5.1 | 5.1 |
| | | | Temperature | 100.0 | 100.0 | 100.0 | 100.0 | 100.0 |
| | | | Time | 5.0 | 5.0 | 5.0 | 5.0 | 5.0 |
| | | | Pressure | Normal pressure | Normal pressure | Normal pressure | Normal pressure | Normal pressure |

| | | | | Toner particles 14 | Toner particles 15 | Toner particles 16 | Toner particles 17 |
|---|---|---|---|---|---|---|---|
| Monomer composition | Binder resin | Styrene | Part(s) by mass | 76.0 | 76.0 | 76.0 | 76.0 |
| | | n-Butyl acrylate | Part(s) by mass | 24.0 | 24.0 | 24.0 | 24.0 |
| | Divinylbenzene | | Part(s) by mass | 0.1 | 0.1 | 0.1 | 0.1 |
| | Copper phthalocyanine pigment | | Part(s) by mass | 6.5 | 6.5 | 6.5 | 6.5 |
| | Polyester-based resin | | Part(s) by mass | 5.0 | 5.0 | 5.0 | 5.0 |
| | Charge control agent | | Part(s) by mass | 0.4 | 0.4 | 0.4 | 0.4 |
| | Charge control resin | | Part(s) by mass | 0.4 | 0.4 | 0.4 | 0.4 |
| | Release agent | | Part(s) by mass | 10.0 | 10.0 | 10.0 | 10.0 |
| Initiator | Oil-soluble initiator | | Part(s) by mass | 20.0 | 20.0 | 20.0 | 20.0 |
| | Water-soluble initiator | | Part(s) by mass | — | — | — | — |
| Organosilicon polymer | Organosilicon compound A | | Kind | Methyl-triethoxy-silane | Methyl-triethoxy-silane | Methyl-triethoxy-silane | Methyl-triethoxy-silane |

TABLE 2-continued

| | | | | | | | |
|---|---|---|---|---|---|---|---|
| | | | Part(s) by mass | 2.7 | 28.0 | 8.3 | 9.7 |
| | | | Addition timing | Dissolving step | Dissolving step | Dissolving step | Dissolving step |
| | | Organosilicon compound B | Kind | Vinyl-triethoxy-silane | Vinyl-triethoxy-silane | Vinyl-triethoxy-silane | Vinyl-triethoxy-silane |
| | | | Part(s) by mass | 0.3 | 2.0 | 1.7 | 0.3 |
| | | | Addition timing | At time of completion of reaction 1 | At time of completion of reaction 1 | At time of completion of reaction 1 | At time of completion of reaction 1 |
| | Production condition | Reaction 1 step | pH | 5.1 | 5.1 | 5.1 | 5.1 |
| | | | Temperature | 70.0 | 70.0 | 70.0 | 70.0 |
| | | | Time | 5.0 | 5.0 | 5.0 | 5.0 |
| | | Reaction 2 step | pH | 8.1 | 8.1 | 8.1 | 8.1 |
| | | | Temperature | 70.0 | 85.0 | 85.0 | 85.0 |
| | | | Time | 6.5 | 6.5 | 6.5 | 6.5 |
| | | Reaction 3 step | pH | 5.1 | 5.1 | 5.1 | 5.1 |
| | | | Temperature | 70.0 | 100.0 | 100.0 | 100.0 |
| | | | Time | 5.0 | 5.0 | 5.0 | 5.0 |
| | | | Pressure | Reduced pressure | Normal pressure | Normal pressure | Normal pressure |

TABLE 3

| | | | | Toner particles 18 | Toner particles 19 | Toner particles 20 | Toner particles 21 | Toner particles 22 |
|---|---|---|---|---|---|---|---|---|
| Monomer composition | Binder resin | Styrene | Part(s) by mass | 76.0 | 76.0 | 76.0 | 76.0 | 76.0 |
| | | n-Butyl acrylate | Part(s) by mass | 24.0 | 24.0 | 24.0 | 24.0 | 24.0 |
| | Divinylbenzene | | Part(s) by mass | 0.1 | 0.1 | 0.1 | 0.1 | 0.1 |
| | Copper phthalocyanine pigment | | Part(s) by mass | 6.5 | 6.5 | 6.5 | 6.5 | 6.5 |
| | Polyester | | Part(s) by mass | 5.0 | 5.0 | 5.0 | 5.0 | 5.0 |
| | Charge control agent | | Part(s) by mass | 0.4 | 0.4 | 0.4 | 0.4 | 0.4 |
| | Charge control resin | | Part(s) by mass | 0.4 | 0.4 | 0.4 | 0.4 | 0.4 |
| | Release agent | | Part(s) by mass | 10.0 | 10.0 | 10.0 | 10.0 | 10.0 |
| Initiator | Oil-soluble initiator | | Part(s) by mass | 20.0 | 20.0 | 20.0 | 20.0 | 20.0 |
| | Water-soluble initiator | | Part(s) by mass | — | — | — | — | — |
| Organosilicon polymer | Organosilicon compound A | | Kind | Methyl-triethoxy-silane | Methyl-triethoxy-silane | Methyl-triethoxy-silane | Methyl-triethoxy-silane | Methyl-triethoxy-silane |
| | | | Part(s) by mass | 8.0 | 9.9 | 7.5 | 9.7 | 8.0 |
| | | | Addition timing | Dissolving step | Dissolving step | Dissolving step | Dissolving step | At time of completion of reaction 2 |
| | Organosilicon compound B | | Kind | Vinyl-triethoxy-silane | Vinyl-triethoxy-silane | Vinyl-triethoxy-silane | Vinyl-triethoxy-silane | Vinyl-triethoxy-silane |
| | | | Part(s) by mass | 2.0 | 0.1 | 2.5 | 0.3 | 2.0 |
| | | | Addition timing | At time of completion of reaction 1 | At time of completion of reaction 1 | Dissolving step | Dissolving step | At time of completion of reaction 1 |
| Production condition | Reaction 1 step | | pH | 5.1 | 5.1 | 5.1 | 5.1 | 5.1 |
| | | | Temperature | 70.0 | 70.0 | 70.0 | 70.0 | 70.0 |
| | | | Time | 5.0 | 5.0 | 5.0 | 5.0 | 5.0 |
| | Reaction 2 step | | pH | 8.1 | 8.1 | 8.1 | 8.1 | 8.1 |
| | | | Temperature | 85.0 | 85.0 | 85.0 | 85.0 | 85.0 |
| | | | Time | 6.5 | 6.5 | 6.5 | 6.5 | 6.5 |
| | Reaction 3 step | | pH | 5.1 | 5.1 | 5.1 | 5.1 | 5.1 |
| | | | Temperature | 100.0 | 100.0 | 100.0 | 100.0 | 100.0 |
| | | | Time | 5.0 | 5.0 | 5.0 | 5.0 | 5.0 |
| | | | Pressure | Normal pressure | Normal pressure | Normal pressure | Normal pressure | Normal pressure |

| | | | | | Toner particles 23 | Toner particles 24 | Toner particles 25 | Toner particles 26 |
|---|---|---|---|---|---|---|---|---|
| | Monomer composition | Binder resin | Styrene | Part(s) by mass | Described in Specification | Described in Specification | 76.0 | 76.0 |
| | | | n-Butyl acrylate | Part(s) by mass | | | 24.0 | 24.0 |
| | | Divinylbenzene | | Part(s) by mass | | | 0.1 | 0.1 |
| | | Copper phthalocyanine pigment | | Part(s) by mass | | | 6.5 | 6.5 |

TABLE 3-continued

| | | | | |
|---|---|---|---|---|
| | Polyester | Part(s) by mass | 5.0 | 5.0 |
| | Charge control agent | Part(s) by mass | 0.4 | 0.4 |
| | Charge control resin | Part(s) by mass | 0.4 | 0.4 |
| | Release agent | Part(s) by mass | 10.0 | 10.0 |
| Initiator | Oil-soluble initiator | Part(s) by mass | 20.0 | 20.0 |
| | Water-soluble initiator | Part(s) by mass | — | — |
| Organosilicon polymer | Organosilicon compound A | Kind | Methyl-triethoxy-silane | Methyl-triethoxy-silane |
| | | Part(s) by mass | 2.2 | 9.0 |
| | | Addition timing | Dissolving step | Dissolving step |
| | Organosilicon compound B | Kind | Vinyl-triethoxy-silane | Vinyl-triethoxy-silane |
| | | Part(s) by mass | 0.8 | 3.0 |
| | | Addition timing | Dissolving step | Dissolving step |
| Production condition | Reaction 1 step | pH | 5.1 | 5.1 |
| | | Temperature | 70.0 | 70.0 |
| | | Time | 5.0 | 5.0 |
| | Reaction 2 step | pH | 8.1 | 8.1 |
| | | Temperature | 70.0 | 70.0 |
| | | Time | 6.5 | 6.5 |
| | Reaction 3 step | pH | 5.1 | 5.1 |
| | | Temperature | 70.0 | 70.0 |
| | | Time | 5.0 | 5.0 |
| | | Pressure | Reduced pressure | Reduced pressure |

TABLE 4

| | | | | Comparative Toner particles 1 | Comparative Toner particles 2 | Comparative Toner particles 3 | Comparative Toner particles 4 | Comparative Toner particles 5 | Comparative Toner particles 6 |
|---|---|---|---|---|---|---|---|---|---|
| Monomer composition | Binder resin | Styrene | Part(s) by mass | 76.0 | 76.0 | 76.0 | 76.0 | 76.0 | 76.0 |
| | | n-Butyl acrylate | Part(s) by mass | 24.0 | 24.0 | 24.0 | 24.0 | 24.0 | 24.0 |
| | Divinylbenzene | | Part(s) by mass | 0.1 | 0.1 | 0.1 | 0.1 | 0.1 | 0.1 |
| | Copper phtalocyanine pigment | | Part(s) by mass | 6.5 | 6.5 | 6.5 | 6.5 | 6.5 | 6.5 |
| | Polyester | | Part(s) by mass | 5.0 | 5.0 | 5.0 | 5.0 | 5.0 | 5.0 |
| | Charge control agent | | Part(s) by mass | 0.4 | 0.4 | 0.4 | 0.4 | 0.4 | 0.4 |
| | Charge control resin | | Part(s) by mass | 0.4 | 0.4 | 0.4 | 0.4 | 0.4 | 0.4 |
| | Release agent | | Part(s) by mass | 10.0 | 10.0 | 10.0 | 10.0 | 10.0 | 10.0 |
| Initiator | Oil-soluble initiator | | Part(s) by mass | 20.0 | 20.0 | 20.0 | 20.0 | 20.0 | 20.0 |
| | Water-soluble initiator | | Part(s) by mass | — | — | — | — | — | — |
| Organosilicon polymer | Organosilicon compound A | | Kind | Methyl-triethoxy-silane | Methyl-triethoxy-silane | Methyl-triethoxy-silane | Tetraethoxy-silane | Dimethyl-diethoxy-silane | Methyl-triethoxy-silane |
| | | | Part(s) by mass | 7.0 | 9.9 | 9.0 | 9.0 | 9.0 | 7.5 |
| | | | Addition timing | Dissolving step | Dissolving step | Dissolving step | Dissolving step | Dissolving step | Dissolving step |
| | Organosilicon compound B | | Kind | Vinyl-triethoxy-silane | Vinyl-triethoxy-silane | Methacryloxy-propyltri-methoxysilane | Vinyl-triethoxy-silane | Vinyl-triethoxy-silane | Vinyl-triethoxy-silane |
| | | | Part(s) by mass | 3.0 | 0.1 | 1.0 | 1.0 | 1.0 | 7.5 |
| | | | Addition timing | Dissolving step | Dissolving step | Dissolving step | Dissolving step | Dissolving step | Dissolving step |
| Production condition | Reaction 1 step | | pH | 5.1 | 5.1 | 5.1 | 5.1 | 5.1 | 5.1 |
| | | | Temperature | 70.0 | 70.0 | 70.0 | 70.0 | 70.0 | 70.0 |
| | | | Time | 5.0 | 5.0 | 5.0 | 5.0 | 5.0 | 5.0 |
| | Reaction 2 step | | pH | 8.1 | 8.1 | 8.1 | 8.1 | 8.1 | 8.1 |
| | | | Temperature | 85.0 | 85.0 | 85.0 | 85.0 | 85.0 | 85.0 |
| | | | Time | 6.5 | 6.5 | 6.5 | 6.5 | 6.5 | 6.5 |
| | Reaction 3 step | | pH | 5.1 | 5.1 | 5.1 | 5.1 | 5.1 | 5.1 |
| | | | Temperature | 100.0 | 100.0 | 100.0 | 100.0 | 100.0 | 100.0 |
| | | | Time | 5.0 | 5.0 | 5.0 | 5.0 | 5.0 | 5.0 |
| | | | Pressure | Normal pressure | Normal pressure | Normal pressure | Normal pressure | Normal pressure | Normal pressure |

TABLE 5

| | Weight-average particle diameter D4 (μm) | RfT3/RT3 | Silicon atom density dSi in surface of each of toner particles (atomic %) | Content of organosilicon polymer (mass %) |
|---|---|---|---|---|
| Toner particles 1 | 6.2 | 0.119 | 19.8 | 6.56 |
| Toner particles 2 | 6.3 | 0.122 | 20.4 | 6.56 |
| Toner particles 3 | 6.3 | 0.051 | 19.9 | 6.56 |
| Toner particles 4 | 6.3 | 0.104 | 15.5 | 6.56 |
| Toner particles 5 | 6.1 | 0.114 | 16.7 | 6.56 |
| Toner particles 6 | 6.2 | 0.080 | 22.5 | 9.53 |
| Toner particles 7 | 6.1 | 0.186 | 19.5 | 6.56 |
| Toner particles 8 | 6.3 | 0.058 | 22.9 | 6.56 |
| Toner particles 9 | 6.1 | 0.111 | 10.8 | 6.56 |
| Toner particles 10 | 6.4 | 0.099 | 9.4 | 6.56 |
| Toner particles 11 | 6.1 | 0.117 | 8.5 | 3.39 |
| Toner particles 12 | 6.0 | 0.132 | 4.9 | 2.73 |
| Toner particles 13 | 6.3 | 0.107 | 2.8 | 2.06 |
| Toner particles 14 | 6.3 | 0.114 | 2.2 | 2.06 |
| Toner particles 15 | 6.4 | 0.082 | 23.4 | 17.40 |
| Toner particles 16 | 6.5 | 0.210 | 18.0 | 6.56 |
| Toner particles 17 | 6.4 | 0.040 | 22.2 | 6.56 |
| Toner particles 18 | 6.0 | 0.255 | 17.9 | 6.56 |
| Toner particles 19 | 6.4 | 0.016 | 24.6 | 6.56 |
| Toner particles 20 | 6.3 | 0.242 | 16.5 | 6.56 |
| Toner particles 21 | 5.9 | 0.015 | 24.1 | 6.56 |
| Toner particles 22 | 6.2 | 0.262 | 18.3 | 6.56 |
| Toner particles 23 | 6.5 | 0.259 | 17.0 | 6.56 |
| Toner particles 24 | 6.0 | 0.251 | 11.5 | 6.56 |
| Toner particles 25 | 6.0 | 0.266 | 2.1 | 2.06 |
| Toner particles 26 | 6.3 | 0.248 | 20.2 | 7.77 |
| Comparative Toner particles 1 | 6.3 | 0.311 | 20.4 | 6.56 |
| Comparative Toner particles 2 | 6.0 | 0.007 | 21.7 | 6.56 |
| Comparative Toner particles 3 | 6.4 | — | 14.5 | 6.56 |
| Comparative Toner particles 4 | 6.5 | — | 9.9 | 6.56 |
| Comparative Toner particles 5 | 6.2 | — | 11.2 | 6.56 |
| Comparative Toner particles 6 | 6.3 | 0.640 | 23.1 | 9.53 |

TABLE 6

| | | | Example 1 Toner particles 1 | Example 2 Toner particles 2 | Example 3 Toner particles 3 | Example 4 Toner particles 4 | Example 5 Toner particles 5 | Example 6 Toner particles 6 | Example 7 Toner particles 7 | Example 8 Toner particles 8 |
|---|---|---|---|---|---|---|---|---|---|---|
| NN | Initial stage | Charge quantity (mC/kg) | −42.1 (A) | −39.8 (A) | −35.6 (A) | −38.8 (A) | −39.5 (A) | −41.8 (A) | −38.5 (A) | −40.1 (A) |
| | | Density | 1.52 (A) | 1.47 (A) | 1.50 (A) | 1.46 (A) | 1.49 (A) | 1.48 (A) | 1.47 (A) | 1.50 (A) |
| | | Solid follow-ability | A | A | A | A | A | A | A | A |
| | After endurance | Density | 1.48 (A) | 1.43 (A) | 1.47 (A) | 1.44 (A) | 1.45 (A) | 1.44 (A) | 1.43 (A) | 1.44 (A) |
| | | Solid follow-ability | A | A | A | A | A | A | A | A |
| | | Member contam-ination | A | B | A | A | A | A | A | A |
| LL | Initial stage | Charge quantity (mC/kg) | −39.5 (A) | −38.2 (A) | −34.7 (B) | −37.8 (A) | −37.6 (A) | −38.7 (A) | −36.2 (A) | −37.5 (A) |
| | | Density | 1.50 (A) | 1.50 (A) | 1.47 (A) | 1.47 (A) | 1.49 (A) | 1.47 (A) | 1.48 (A) | 1.50 (A) |
| | | Solid follow-ability | A | A | A | A | A | A | A | A |
| | After endurance | Density | 1.48 (A) | 1.45 (A) | 1.46 (A) | 1.44 (A) | 1.46 (A) | 1.45 (A) | 1.44 (A) | 1.46 (A) |
| | | Solid follow-ability | A | A | A | A | A | A | A | A |
| | | Member contam-ination | A | B | A | | | | | |

TABLE 6-continued

| | | | Example 1 Toner particles 1 | Example 2 Toner particles 2 | Example 3 Toner particles 3 | Example 4 Toner particles 4 | Example 5 Toner particles 5 | Example 6 Toner particles 6 | Example 7 Toner particles 7 | Example 8 Toner particles 8 |
|---|---|---|---|---|---|---|---|---|---|---|
| HH | Initial stage | Charge quantity (mC/kg) | −40.0 (A) | −38.5 (A) | −35.0 (A) | −38.1 (A) | −38.9 (A) | −40.2 (A) | −36.6 (A) | −38.3 (A) |
| | | Density | 1.49 (A) | 1.46 (A) | 1.47 (A) | 1.46 (A) | 1.47 (A) | 1.45 (A) | 1.45 (A) | 1.48 (A) |
| | | Solid follow-ability | A | A | A | A | A | A | A | A |
| | After endurance | Density | 1.47 (A) | 1.43 (A) | 1.43 (A) | 1.43 (A) | 1.45 (A) | 1.44 (A) | 1.43 (A) | 1.44 (A) |
| | | Solid follow-ability | A | A | A | A | A | A | A | A |
| | | Member contam-ination | A | B | A | A | A | A | A | A |
| Cold offset end point | | | 110 | 110 | 110 | 110 | 110 | 110 | 110 | 110 |

TABLE 7

| | | | Example 9 Toner particles 9 | Example 10 Toner particles 10 | Example 11 Toner particles 11 | Example 12 Toner particles 12 | Example 13 Toner particles 13 |
|---|---|---|---|---|---|---|---|
| NN | Initial stage | Charge quantity (mC/kg) | −35.5 (A) | −36.7 (A) | −34.8 (B) | −33.6 (B) | −31.1 (B) |
| | | Density | 1.48 (A) | 1.47 (A) | 1.47 (A) | 1.47 (A) | 1.45 (A) |
| | | Solid followability | A | A | A | A | A |
| | After endurance | Density | 1.43 (A) | 1.45 (A) | 1.38 (B) | 1.39 (B) | 1.38 (B) |
| | | Solid followability | A | A | A | A | A |
| | | Member contamination | A | A | A | A | A |
| LL | Initial stage | Charge quantity (mC/kg) | −33.2 (B) | −31.8 (B) | −33.7 (B) | −33.0 (B) | −30.8 (B) |
| | | Density | 1.44 (A) | 1.43 (A) | 1.44 (A) | 1.45 (A) | 1.45 (A) |
| | | Solid followability | A | A | A | A | A |
| | After endurance | Density | 1.38 (B) | 1.37 (B) | 1.31 (B) | 1.34 (B) | 1.29 (C) |
| | | Solid followability | B | B | B | B | C |
| | | Member contamination | A | A | A | A | A |
| HH | Initial stage | Charge quantity (mC/kg) | −34.7 (B) | −33.9 (B) | −34.0 (B) | −33.8 (B) | −30.8 (B) |
| | | Density | 1.47 (A) | 1.45 (A) | 1.46 (A) | 1.45 (A) | 1.45 (A) |
| | | Solid followability | A | A | A | A | A |
| | After endurance | Density | 1.43 (A) | 1.42 (A) | 1.34 (B) | 1.30 (B) | 1.31 (B) |
| | | Solid followability | A | A | A | B | B |
| | | Member contamination | A | A | A | A | A |
| Cold offset end point | | | 110 | 110 | 110 | 110 | 110 |

| | | | Example 14 Toner particles 14 | Example 15 Toner particles 15 | Example 16 Toner particles 16 | Example 17 Toner particles 17 |
|---|---|---|---|---|---|---|
| NN | Initial stage | Charge quantity (mC/kg) | −31.3 (B) | −41.2 (A) | −36.1 (A) | −38.5 (A) |
| | | Density | 1.44 (A) | 1.49 (A) | 1.48 (A) | 1.50 (A) |
| | | Solid followability | A | A | A | A |
| | After endurance | Density | 1.36 (B) | 1.44 (A) | 1.38 (B) | 1.34 (B) |
| | | Solid followability | A | A | B | B |
| | | Member contamination | A | B | A | A |
| LL | Initial stage | Charge quantity (mC/kg) | −29.4 (C) | −40.0 (A) | −36.3 (A) | −37.7 (A) |
| | | Density | 1.41 (A) | 1.47 (A) | 1.45 (A) | 1.45 (A) |
| | | Solid followability | B | A | A | A |
| | After endurance | Density | 1.26 (C) | 1.43 (A) | 1.35 (B) | 1.32 (B) |
| | | Solid followability | C | A | B | B |
| | | Member contamination | A | B | A | A |

TABLE 7-continued

| | | | | | | |
|---|---|---|---|---|---|---|
| HH | Initial stage | Charge quantity (mC/kg) | −28.1 (C) | −38.4 (A) | −35.1 (A) | −38.0 (A) |
| | | Density | 1.40 (A) | 1.47 (A) | 1.44 (A) | 1.47 (A) |
| | | Solid followability | B | A | A | A |
| | After endurance | Density | 1.30 (B) | 1.44 (A) | 1.35 (B) | 1.33 (B) |
| | | Solid followability | B | A | B | B |
| | | Member contamination | A | B | A | A |
| Cold offset end point | | | 110 | 110 | 110 | 110 |

TABLE 8

| | | | Example 18 Toner particles 18 | Example 19 Toner particles 19 | Example 20 Toner particles 20 | Example 21 Toner particles 21 | Example 22 Toner particles 22 |
|---|---|---|---|---|---|---|---|
| NN | Initial stage | Charge quantity (mC/kg) | −35.8 (A) | −39.8 (A) | −35.6 (A) | −39.4 (A) | −41.6 (A) |
| | | Density | 1.47 (A) | 1.48 (A) | 1.47 (A) | 1.46 (A) | 1.46 (A) |
| | | Solid followability | A | A | A | A | A |
| | After endurance | Density | 1.35 (B) | 1.33 (B) | 1.35 (B) | 1.35 (B) | 1.34 (B) |
| | | Solid followability | B | B | B | B | B |
| | | Member contamination | A | A | A | A | A |
| LL | Initial stage | Charge quantity (mC/kg) | −36.5 (A) | −38.0 (A) | −36.7 (A) | −38.9 (A) | −40.1 (A) |
| | | Density | 1.45 (A) | 1.47 (A) | 1.45 (A) | 1.44 (A) | 1.46 (A) |
| | | Solid followability | A | A | A | A | A |
| | After endurance | Density | 1.33 (B) | 1.32 (B) | 1.35 (B) | 1.26 (C) | 1.34 (B) |
| | | Solid followability | B | B | B | C | B |
| | | Member contamination | A | A | A | A | A |
| HH | Initial stage | Charge quantity (mC/kg) | −35.3 (A) | −37.9 (A) | −35.4 (A) | −37.9 (A) | −39.7 (A) |
| | | Density | 1.45 (A) | 1.46 (A) | 1.44 (A) | 1.46 (A) | 1.45 (A) |
| | | Solid followability | A | A | A | A | A |
| | After endurance | Density | 1.34 (B) | 1.33 (B) | 1.28 (C) | 1.32 (B) | 1.33 (B) |
| | | Solid followability | B | B | C | B | B |
| | | Member contamination | A | A | A | A | A |
| Cold offset end point | | | 110 | 110 | 115 | 115 | 115 |

| | | | Example 23 Toner particles 23 | Example 24 Toner particles 24 | Example 25 Toner particles 25 | Example 26 Toner particles 26 |
|---|---|---|---|---|---|---|
| NN | Initial stage | Charge quantity (mC/kg) | −35.8 (A) | −31.5 (B) | −28.7 (C) | −36.0 (A) |
| | | Density | 1.48 (A) | 1.47 (A) | 1.40 (A) | 1.48 (A) |
| | | Solid followability | A | A | B | A |
| | After endurance | Density | 1.35 (B) | 1.34 (B) | 1.25 (C) | 134 (B) |
| | | Solid followability | B | B | C | B |
| | | Member contamination | B | B | A | A |
| LL | Initial stage | Charge quantity (mC/kg) | −36.2 (A) | −30.8 (B) | −29.1 (C) | −36.4 (A) |
| | | Density | 1.47 (A) | 1.45 (A) | 1.38 (B) | 1.45 (A) |
| | | Solid followability | A | A | B | A |
| | After endurance | Density | 1.33 (B) | 1.25 (C) | 1.23 (D) | 1.33 (B) |
| | | Solid followability | B | C | C | B |
| | | Member contamination | B | B | A | A |
| HH | Initial stage | Charge quantity (mC/kg) | −35.6 (A) | −30.2 (B) | −26.0 (C) | −35.3 (A) |
| | | Density | 1.47 (A) | 1.46 (A) | 1.38 (B) | 1.48 (A) |
| | | Solid followability | A | A | B | A |
| | After endurance | Density | 1.34 (B) | 1.25 (C) | 1.22 (D) | 1.26 (C) |
| | | Solid followability | B | C | C | C |
| | | Member contamination | B | B | A | A |
| Cold offset end point | | | 110 | 110 | 115 | 115 |

TABLE 9

| | | | Comparative Example 1 Comparative Toner particles 1 | Comparative Example 2 Comparative Toner particles 2 | Comparative Example 3 Comparative Toner particles 3 | Comparative Example 4 Comparative Toner particles 4 | Comparative Example 5 Comparative Toner particles 5 | Comparative Example 6 Comparative Toner particles 6 |
|---|---|---|---|---|---|---|---|---|
| NN | Initial stage | Charge quantity (mC/kg) | −35.4 (A) | −40.8 (A) | −35.4 (A) | −30.2 (B) | −35.8 (A) | −30.7 (B) |
| | | Density | 1.46 (A) | 1.45 (A) | 1.40 (A) | 1.38 (B) | 1.41 (A) | 1.42 (A) |
| | | Solid followability | A | A | A | A | A | A |
| | After endurance | Density | 1.19 (E) | 1.17 (E) | 1.18 (E) | 1.18 (E) | 1.13 (E) | 1.16 (E) |
| | | Solid followability | D | D | D | D | E | D |
| | | Member contamination | A | A | B | A | A | A |
| LL | Initial stage | Charge quantity (mC/kg) | −36.4 (A) | −37.7 (A) | −36.4 (A) | −29.6 (C) | −36.8 (A) | −32.2 (B) |
| | | Density | 1.43 (A) | 1.44 (A) | 1.42 (A) | 1.36 (B) | 1.42 (A) | 1.40 (A) |
| | | Solid followability | A | A | B | B | A | A |
| | After endurance | Density | 1.18 (E) | 1.18 (E) | 1.17 (E) | 1.12 (E) | 1.11 (E) | 1.12 (E) |
| | | Solid followability | D | D | D | E | E | D |
| | | Member contamination | A | A | B | A | A | A |
| HH | Initial stage | Charge quantity (mC/kg) | −35.2 (A) | −36.4 (A) | −35.7 (A) | −28.9 (C) | 35.5 (A) | 30.9 (B) |
| | | Density | 1.44 (A) | 1.44 (A) | 1.40 (A) | 1.38 (B) | 1.40 (A) | 1.44 (A) |
| | | Solid followability | A | A | B | B | A | A |
| | After endurance | Density | 1.16 (E) | 1.17 (E) | 1.13 (E) | 1.10 (E) | 1.13 (E) | 1.16 (E) |
| | | Solid followability | D | D | E | E | E | D |
| | | Member contamination | A | A | B | A | A | A |
| Cold offset end point | | | 115 | 115 | 115 | 115 | 115 | 115 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-014101, filed Jan. 28, 2016, which is hereby incorporated by reference herein in its entirety.

What is claimed is:

1. A toner, comprising toner particles each having a surface layer containing an organosilicon polymer, the organosilicon polymer comprising a siloxane-based polymer having a partial structure represented by formula (1) and a partial structure represented by formula (2)

$$R—SiO_{3/2} \quad (1)$$

where R represents an alkyl group having 1 to 6 carbon atoms, or a phenyl group;

$$Rf—SiO_{3/2} \quad (2)$$

where Rf represents a structure represented by any one of formulae (i) and (ii), * in each of the formulae (i) and (ii) represents a bonding portion with a silicon atom, and L in the formula (ii) represents a methylene group, an ethylene group, or a phenylene group $$*—CH{=}CH_2 \quad (i)$$

$$*\text{-}L\text{-}CH{=}CH_2 \quad (ii)$$

wherein an area RT3 of a peak assigned to the partial structure represented by formula (1) and an area RfT3 of a peak assigned to the partial structure represented by formula (2) satisfy 0.300>(RfT3/RT3)>0.010 in a chart obtained by $^{29}$Si-NMR measurement of a tetrahydrofuran-insoluble matter of the toner particles.

2. A toner according to claim 1, wherein when a total of a carbon atom density dC, an oxygen atom density dO, and a silicon atom density dSi in the surface of the toner particle is defined as 100.0 atomic %, the silicon atom density dSi is 2.5 to less than 28.6 atomic % in X-ray photoelectron spectroscopic analysis of a surface of each of the toner particles.

3. A toner according to claim 1, wherein the toner particles satisfy $$0.200>(RfT3/RT3)\geq 0.050.$$

4. A toner according to claim 1, wherein the toner particles each contain 2.40 to 9.80 mass % of the organosilicon polymer.

* * * * *